US005554017A

United States Patent [19]

Kohsokabe et al.

[11] Patent Number: 5,554,017

[45] Date of Patent: Sep. 10, 1996

[54] SCROLL FLUID MACHINE, SCROLL MEMBER AND PROCESSING METHOD THEREOF

[75] Inventors: Hirokatsu Kohsokabe, Ibaraki-ken; Hiroshi Iwata, Odawara; Kazuhiro Endoh, Ibaraki-ken; Yasuhiro Oshima, Tochigi-ken, all of Japan

[73] Assignee: Hitachi, Ltd., Tokyo, Japan

[21] Appl. No.: 368,712

[22] Filed: Jan. 3, 1995

Related U.S. Application Data

[62] Division of Ser. No. 992,051, Dec. 17, 1992, Pat. No. 5,427,512.

[30] Foreign Application Priority Data

Dec. 20, 1991 [JP] Japan ..... 3-338970

[51] Int. Cl.[6] ..... F01C 1/04

[52] U.S. Cl. ..... 418/55.2; 29/888.02

[58] Field of Search ..... 418/55.2, 150; 29/888.02, 889.7

[56] References Cited

U.S. PATENT DOCUMENTS 5,103,558 4/1992 Herrick et al. ..... 29/888.022
5,122,040 6/1992 Fields ..... 418/55.2
5,151,020 9/1992 Mori et al. ..... 418/55.2
5,314,317 5/1994 Abe et al. ..... 418/55.2

FOREIGN PATENT DOCUMENTS 63682 3/1989 Japan ..... 418/55.2

*Primary Examiner*—Charles Freay
*Attorney, Agent, or Firm*—Antonelli, Terry, Stout & Kraus

[57] ABSTRACT

A scroll fluid machine in which, even if volute bodies on the orbiting side and on the fixed side are different in material from each other, the volute bodies can be brought to their respective strengths equal to each other, dimension can be miniaturized or reduced, and internal leakage is reduced so that an attempt can be made to improve performance. In the scroll fluid machine, a curve of either one of an orbiting outward curve and a orbiting inward curve of a volute body on the orbiting side is formed by an algebraic spiral expressed by the following equation in the form of polar coordinates $r=a\cdot\theta^k$ (here, r: radius vector, θ: angle of deviation, a: coefficient, k: exponent). This curve and any one of a fixed outward curve and a fixed inward curve of the volute body on the fixed side are arranged with a phase difference of about 180 degrees. Thicknesses of respective volute walls on the orbiting side and on the fixed side are adequately or suitably changed.

9 Claims, 20 Drawing Sheets

α = 0°

α = 30°

α = −30°

SCROLL FLUID MACHINE, SCROLL MEMBER AND PROCESSING METHOD THEREOF

CROSS-REFERENCE TO RELATED APPLICATIONS

The present application is a divisional application of U.S. Ser. No. 07/992,051, filed Dec. 17, 1992 which issued on Jun. 27, 1995 as U.S. Pat. No. 5,427,512.

BACKGROUND OF THE INVENTION

The present invention relates to a displacement type scroll fluid machine and, more particularly, to a scroll fluid machine, a scroll member and a processing method thereof, in which a curve of each of a pair of volute bodies is formed by an algebraic spiral.

A conventional scroll fluid machine comprises a fixed scroll and an orbiting scroll respectively having volute bodies of the same configuration and eccentrically combined with each other. As a volute configuration, an involute curve is generally used in which a volute pitch and a thickness of a volute wall become constant. As an advantage using the involute curve as the volute curve, it can be mentioned that processing is easily executed in which inward and outward volute curves can simultaneously be processed by a simple cutter, because a normal pitch of the volute is constant. However, since the thickness of the volute wall is constant, stress of a central portion of the volute body, which becomes the highest pressure, is raised. Thus, this is apt to become a problem in relation to strength. That is, the thickness is decided from constraint on the strength. The winding number of the volute body is decided from a running pressure ratio that is a design condition. A height of the volute body, a volute pitch and the like are decided from a stroke volume or piston displacement. If a configuration of one of the volute bodies, for example, a orbiting scroll is decided, a configuration of a fixed scroll in mesh with the orbiting scroll is decided such that an inside or inward envelope of a orbiting inward curve is selected to a fixed inward curve. Further, since a central portion of the volute body is also high in inside pressure difference, the conventional scroll fluid machine is disadvantageous in that a reduction in performance is likely to occur due to internal leakage of fluid. Moreover, since the volute pitch is constant in the involute curve, a displacement changing ratio is also constant. Accordingly, in a case where a built-in volume ratio, that is, a ratio between a sealed displacement (stroke volume) at the outermost periphery and a sealed volume at the innermost periphery tends to increase within a predetermined dimension, a problem arises in that, if the winding number of the volute increases, the volute pitch is reduced, and, because the volute wall thickness is constant, an orbiting radius is reduced, and the stroke volume is also reduced.

In U.S. Pat. No. 3,802,809, the volute wall thickness of a portion adjacent to the central portion of each of the volute bodies is thickened or increases so as to be capable of withstanding high pressure. Furthermore, in U.S. Pat. No. 2,324,168 and Japanese Patent Laid-Open No. 3-11102, the volute pitch is changed to change the built-in volume ratio.

In U.S. Pat. No. 3,802,809, because the volute wall thickness of a winding beginning or start portion of each of the volute bodies increases or is thickened, the problem relating to stress is addressed. Since, however, a region in which the thickness of the volute wall increases is limited to a portion of the winding beginning or start, an advantage to reduce the internal leakage of the fluid through an end face of the volute body is reduced. Further, since the thickness of the volute wall is constant within a portion except for the winding start portion, it is impossible to increase both the stroke volume and the built-in volume ratio within a predetermined dimension similarly to the involute curve.

Moreover, in the scroll fluid machine disclosed in U.S. Pat. No. 2,324,168 and Japanese Patent Laid-Open No. 3-11102, a volute pitch is changed to change a built-in volume ratio. However, for example, when the volute pitch is reduced from the outer periphery of the volute to the center thereof in an attempt to increase the built-in volume ratio, the more a location approaches a central portion (winding start) of the volute, the less the thickness of the volute wall is reduced, and no consideration is given with respect to the strength. On the contrary, since the more a location approaches the outer periphery of the volute, the more the thickness of the volute wall increases. Accordingly, the stroke volume is reduced. In this manner, a vortex curve capable of reducing or miniaturizing the volute body less than the involute curve in a case where both the stroke volume and the built-in volume ratio increase and in a case of the same or identical stroke volume and built-in volume ratio is unknown. Furthermore, a geometrical theory of the volute body in which the volute pitch and the thickness of the volute wall change, that is, an arrangement or constructional method of the vortex curve and the volute body does not become clear or apparent.

SUMMARY OF THE INVENTION

It is a first object of the invention to provide a scroll fluid machine having a pair of volute bodies in which a thickness of each of the volute bodies changes gradually in accordance with a winding angle of a volute.

It is a second object of the invention to provide a scroll fluid machine wherein each of a pair of volute bodies can be reduced in size or miniaturized less than an involute curve while strength of the volute body is secured, to reduce internal leakage of fluid so that an attempt can be made to improve performance.

It is a third object of the invention to provide a scroll fluid machine in which, even in a case where a fixed scroll and a orbiting scroll are of different material from each other, a similar strength can be secured in both the fixed scroll and the orbiting scroll.

It is a fourth object of the invention to provide a method of processing a scroll member, which has a volute body whose thickness gradually changes in accordance with a winding angle of a volute.

In order to achieve the first object, a scroll fluid machine according to the invention is arranged such that a pair of scroll members, each formed by an end plate and a volute body perpendicular thereto, are in mesh with each other with the volute body facing inwardly, and one of the scroll members is moved in revolution at a predetermined orbiting radius so as not to be apparently revolved about its own axis with respect to the other scroll member, with the scroll fluid machine being characterized in that basic volute curves of volute bodies of the respective scrolls are formed by an algebraic spiral which is expressed by the following equation, when it is assumed that a radius vector is $\underline{r}$, an angle of deviation or argument is $\theta$, a coefficient of the algebraic spiral is $\underline{a}$, and an index or exponent of the algebraic spiral is $\underline{k}$ in the form of polar coordinates:

$$r=a\cdot\theta^k \quad (1)$$

Further, the exponent k of the one algebraic spiral is an algebraic exponent in which k<1.0, while the other algebraic spiral is formed with the one algebraic spiral rotated about 180°.

In order to achieve the second object of the invention, a scroll fluid machine according to the invention is arranged such that a pair of scroll members, respectively formed by end plates and volute bodies perpendicular to the end plates, are in mesh with each other with the volute bodies facing inwardly, and that one of the scroll members is moved in revolution at a predetermined orbiting radius so as not revolve about its own axis, with the scroll fluid machine being characterized in that basic volute curves of the volute bodies of the respective scrolls are formed by an algebraic spiral in which an exponent k of the algebraic θ spiral is changed correspondingly to an angle of deviation when it is assumed that a radius vector is r, an angle of deviation or argument is θ, a coefficient of the algebraic spiral is a, and an index or exponent of the algebraic spiral is k in the form of polar coordinates.

Moreover, a scroll fluid machine according to the invention comprises a stationary scroll member and a orbiting scroll member having respective volute bodies thereof, characterized in that a clearance volume defined between abutting points of innermost regions of both the respective volute bodies is so arranged as to become substantially zero in keeping with relative revolving motions of both the respective volute bodies, and that the respective volute bodies have such a configuration that a thickness of the volute wall is gradually changed in accordance with a winding angle of the volute with an algebraic curve serving as a basis vortex curve.

The algebraic spiral is such that an exponent k is k>1.0, and a coefficient a is set to a constant. The exponent k of the algebraic spiral is changed as a function of an angle of deviation θ.

In order to achieve the third object of the invention, a scroll fluid machine according to the invention is arranged such that an algebraic spiral of one of a pair of scroll members is rotated through an angle α with an origin thereof serving as a center, and an algebraic spiral of the other scroll member is rotated through an angle (180°-α) with an origin serving as a center.

Moreover, the arrangement is such that the one scroll member is a orbiting scroll member, and a thickness of a volute body of the one scroll member is thicker than a thickness of a volute body of the other scroll member.

Furthermore, a scroll fluid machine in which a pair of scroll members each formed by an end plate and a volute body perpendicular thereto are in mesh with each other with the volute body facing inwardly, and one of the scroll members executes revolving motion with a orbiting radius e so as not to be apparently revolved about an axis thereof with respect to the other scroll member, is characterized in that radii e1 and e2 have the relationship of e=e1+e2 with respect to the orbiting radius e, that respective volute bodies of both scrolls are formed by an inward envelope at the time outward curves moves in orbiting algebraic spirals of both the spirals at radii e1 and e2, and that the inward curve is formed by an outward envelope at the time the algebraic spirals of the respective scrolls are caused to execute orbiting motion at radii e1 and e2.

In order to achieve the fourth object of the invention, a method of processing a scroll member, according to the invention, is characterized in that an outward curve and an inward curve of a volute body of the scroll member is formed by an algebraic spiral or an envelope at the time the algebraic spiral is moved in orbiting, and that a center of a cutter is moved along the outward curve and the inward curve, to execute processing of the volute body.

The algebraic spirals are used such that the basic volute curve of each of the volute bodies of both the scrolls is formed by the algebraic spiral, as the basic volute curve, when the radius vector is r, the angle of deviation is θ, the coefficient of the algebraic spiral is a, and the exponent of the algebraic spiral is k, in the form of polar coordinates. Accordingly, it is possible to simply change the pitch of the volute only by changing a value of the exponent k of the algebraic spiral. In a case where the exponent k is k>1.0, the more the winding angle of the volute (angle of deviation θ) increases, the more the pitch of the volute increases. On the contrary, in a case where k<1.0, the more the winding angle (angle of deviation θ) of the volute increases, the less the pitch of the volute decreases. Further, the volute bodies of the respective scrolls are such that a curve on one side is formed by an algebraic spiral, while a curve on the other side is formed by one of a pair of envelopes drawn when the algebraic spiral of the volute body of the other scroll executes circular motion at the orbiting radius. Accordingly, the volute body on the fixed side and the volute body on the orbiting side are such that contact between both the volute bodies for forming a plurality of sealed volumes is guaranteed or assured geometrically.

Furthermore, the scroll fluid machine provided with a stationary scroll member and a orbiting scroll member having respective volute bodies thereof is arranged such that the clearance volume defined between abutment points of innermost regions of both the respective volute bodies becomes substantially zero in keeping with relative revolving motion of both the volute bodies, and that the respective volute bodies have such a configuration that the thickness of the volute wall changes gradually in accordance with the winding angle of the volute with the algebraic spiral serving as the basic volute curve. Accordingly, it is possible to reduce a top clearance, to reduce re-expansion loss, and to improve efficiency.

Moreover, the exponent k of the algebraic spiral is brought to k<1.0, or the algebraic spiral in which the coefficient a or the exponent k is brought to a function of the angle of deviation θ is brought to the basic volute curve of the volute body, whereby it is possible to suitably change the thickness of the volute wall.

In an arrangement in which the algebraic spiral of the one scroll member is rotated by the angle a with the origin thereof serving as the center, and the algebraic spiral of the other scroll member is rotated by the angle (180°-α) with the origin thereof serving as the center, the algebraic spiral of the one scroll member is rotated by the angle α. Accordingly, it is possible to form the scroll members with the thickness of two volute walls changed by the angle α. Thus, it is possible to secure the strength of the volute body in a case also where the materials of both the volute bodies are different from each other.

Furthermore, the radii e1 and e2 have the relationship of e=e1+e2 with respect to the orbiting radius e, and the volute bodies of both the respective scrolls are arranged such that the outward curve is formed by the inward envelope at the time the algebraic spirals of both the scrolls are moved in orbiting at the radii e1 and e2, and the inward curve is formed by the outward envelope at the time the algebraic spirals of both the scrolls are moved in orbiting at the radii of e1 and e2. Accordingly, the magnitude relationship between the radii e1 and e2 and the values thereof are changed, whereby it is possible to form the scrolls with the two volute thicknesses changed. Even in a case where the materials of both the volute bodies are different from each other, it is possible to secure the strength of each of the volute bodies. Further, it is possible to reduce or miniaturize the dimension of each of the volute bodies less than that of the involute curve. Thus, it is possible to provide the scroll fluid machine in which internal leakage of fluid is reduced so that an attempt can be made to improve performance.

The outward curve and the inward curve of the volute bodies of the scroll members are formed by the algebraic spiral or by envelopes at the time the algebraic spiral is moved in orbiting, and the center of the cutter is moved along the outward curve and the inward curve, to execute processing of the volute body. Accordingly, it is possible to continuously process the volute body. It is possible to process a tooth side surface with superior dimensional accuracy and efficiently.

Figure 40:
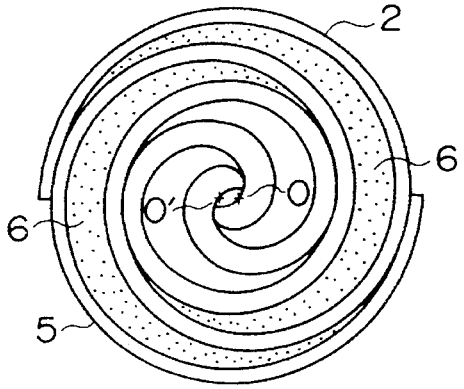
Figure 41:
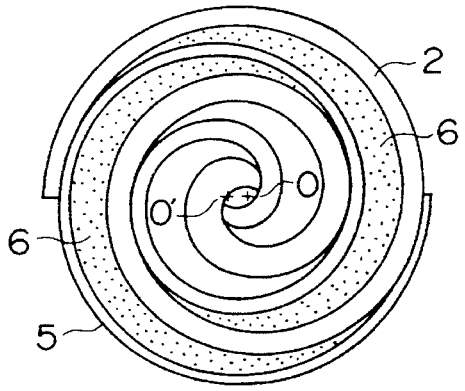
Figure 42:
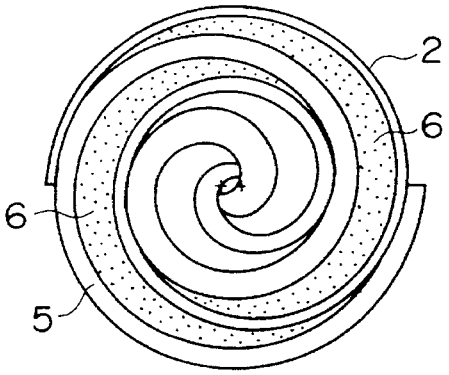
Figure 43:
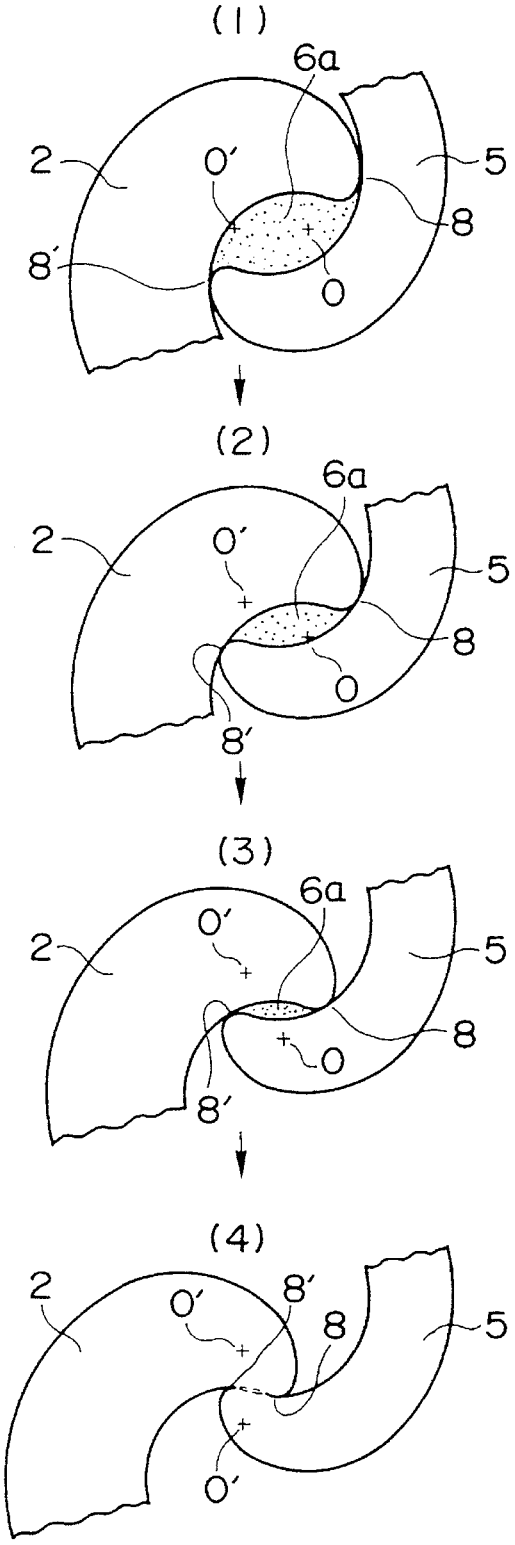
Figure 44:
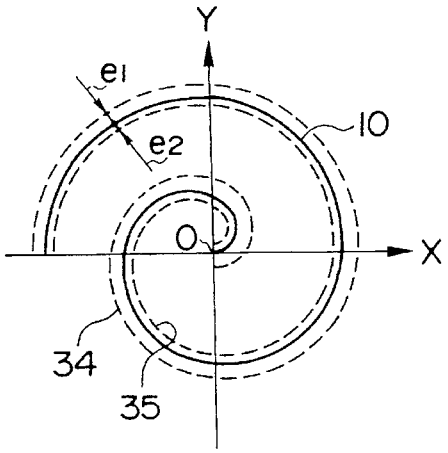
Figure 45:
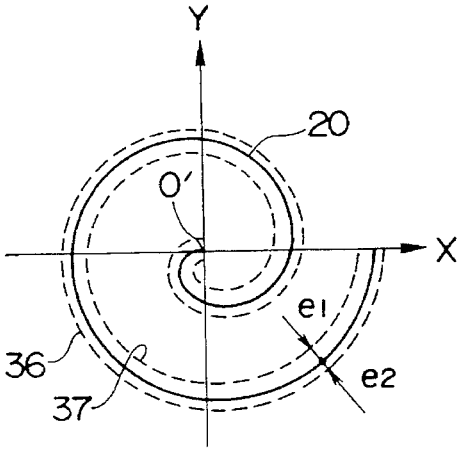
Figure 46:
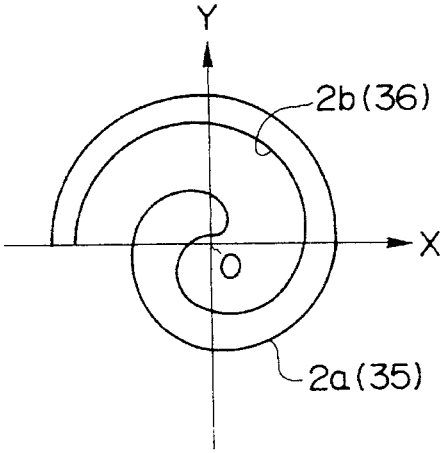
Figure 47:
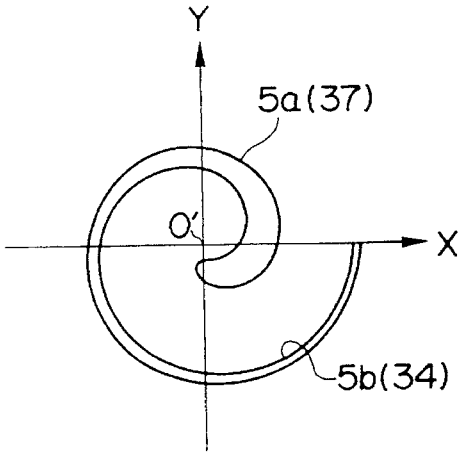

2FIG. 39 is a schematic view for the forming method of the scroll configuration of the invention;

FIG. 40 is a top plan view showing a change in scroll configuration due to a change in angle $\alpha$ in accordance with the invention;

FIG. 41 is a top plan view showing the change in scroll configuration due to the change in angle $\alpha$ in accordance with the invention;

FIG. 42 is a top plan view showing the change in scroll configuration due to the change in angle $\alpha$ in accordance with the invention;

FIG. 43 is a top plan view showing a meshing condition between central portions of respective volute bodies in accordance with the invention;

FIG. 44 is a view for description of a forming method of a scroll configuration, showing a still further embodiment of the invention;

FIG. 45 is a view for description of the forming method of the scroll configuration of the invention;

FIG. 46 is a view for description of the forming method of the scroll configuration of the invention; and FIG. 47 is a view for description of the forming method of the scroll configuration, showing the embodiment of the invention.

DESCRIPTION OF THE PREFERRED EMBODIMENTS

Figure 1:
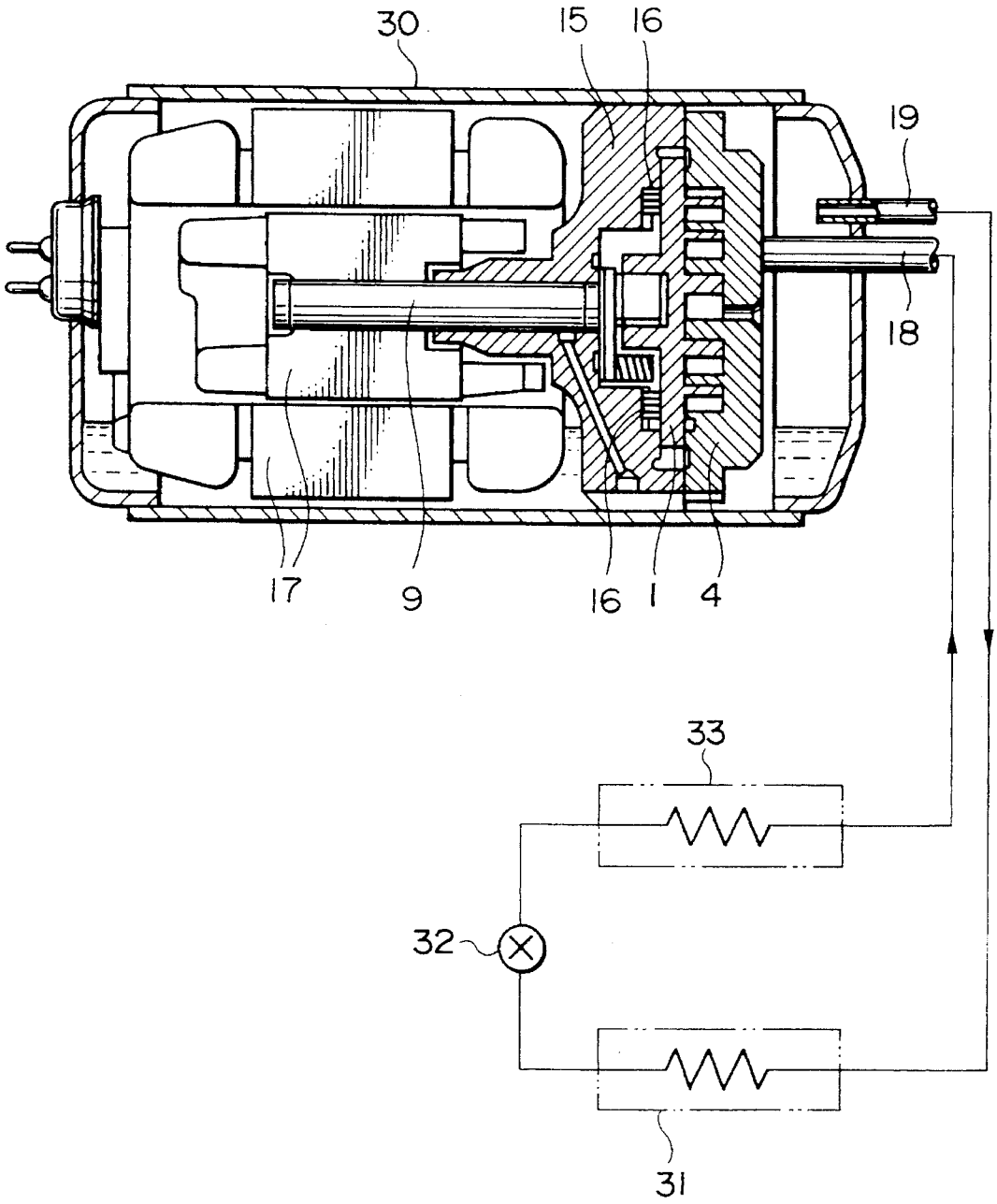
FIG. 1 is a schematic partial cross-sectional view of an air conditioning facility which loads a scroll compressor, showing a first embodiment of the invention.

As shown in FIG. 1, a refrigerating cycle comprises a scroll compressor 30, a condenser 31, an expansion valve 32, and a vaporizer or evaporator 33. The scroll compressor 30 includes a orbiting scroll 1 and a fixed scroll 4 having respective volute bodies thereof the same in configuration as each other. Each of the volute bodies is such that a thickness of the volute body continuously changes in accordance with a winding angle of a volute. The scroll compressor 30 further includes a crankshaft 9 for rotating the orbiting scroll 1, a frame 15 supporting the crankshaft 9, a pair of Oldham's rings 16 permitting the orbiting scroll 1 to be moved in revolution but preventing the orbiting scroll 1 from being rotated about its own axis, a motor 17 for driving the crankshaft 9, and a suction pipe 18 and a discharge pipe 19.

Figure 4:
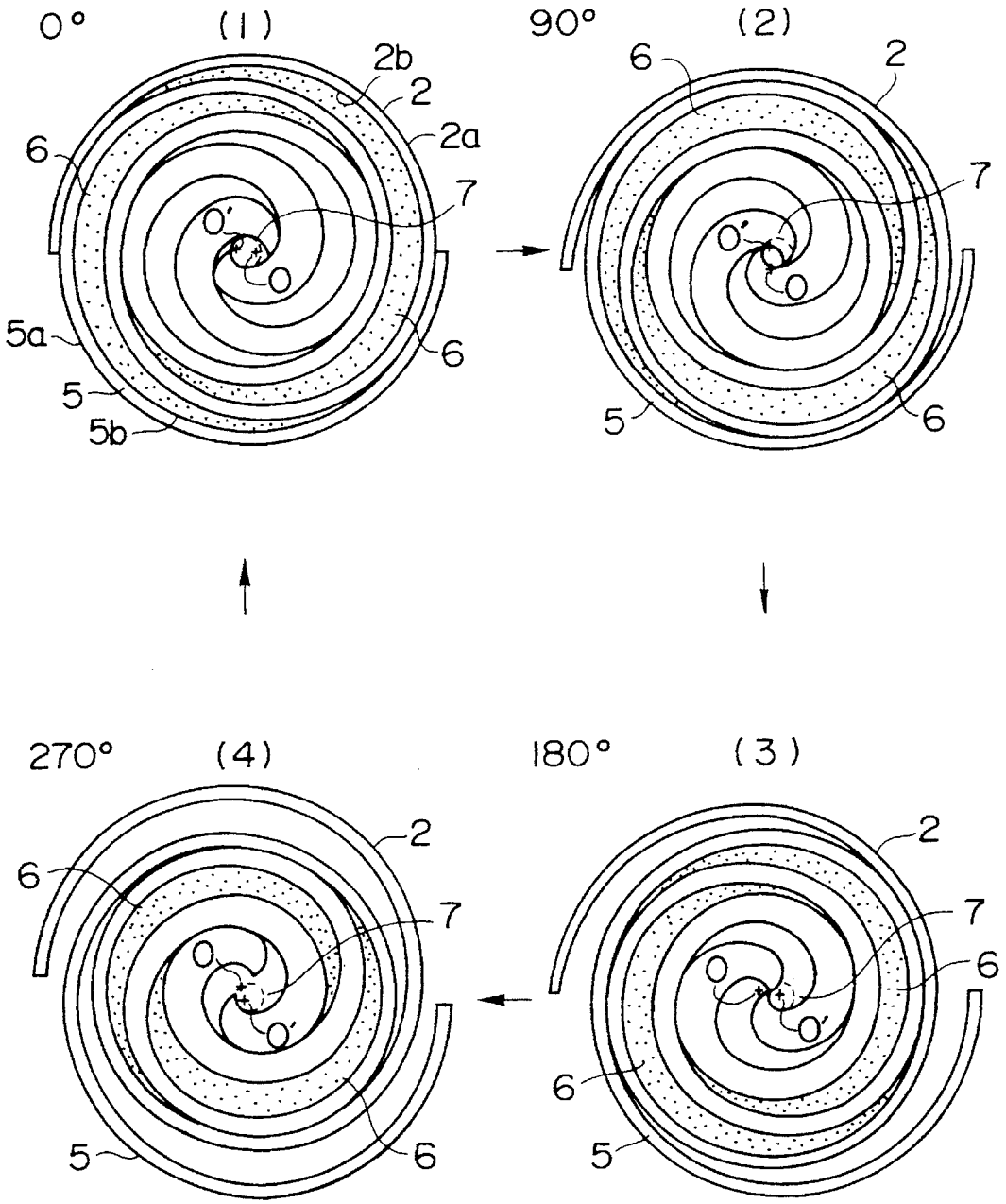
FIG. 4 is a top plan view showing an operational principle of the scroll compressor according to the invention.

In the scroll compressor arranged as described above, when the motor 17 is energized whereby the crankshaft 9 is rotated, the orbiting scroll 1 is moved in revolution without being revolved about its own axis by the Oldham's rings 16. As shown in FIG. 4, a compressive action of refrigerant between both the scrolls 1 and 4 is executed. Compressed refrigerant having high temperature and high pressure flows into the condenser 31 from the discharge pipe 19 as shown by the arrow, executes heat exchanging, and is liquefied. The compressed refrigerant is restricted so as to be adiabatically expanded so that the compressed refrigerant is reduced in temperature and pressure. By heat exchanging due to the evaporator 33, the compressed refrigerant is gasified and, subsequently, is drawn into the scroll compressor 30 through the suction pipe 18.

Figure 2:
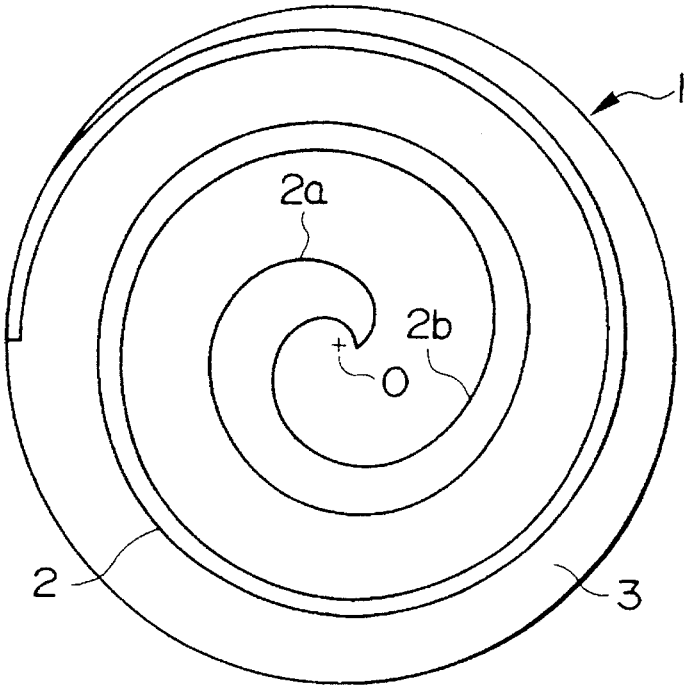
FIG. 2 is a top plan view of orbiting scroll according to the invention.
Figure 3:
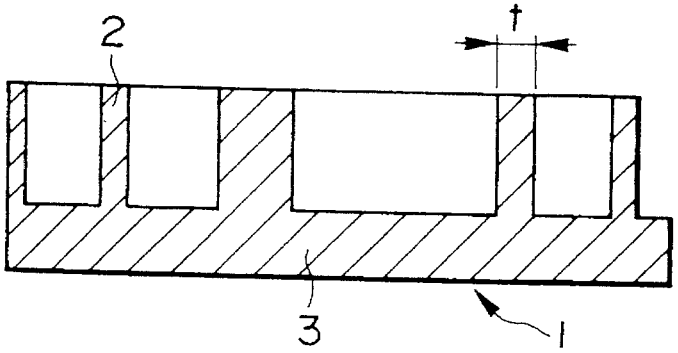
FIG. 3 is a transverse cross-sectional view of the orbiting scroll member of FIG. 1.

As shown in FIGS. 2 and 3, the orbiting scroll 1 is formed by a volute body 2 on the orbiting side and an end plate 3. The volute body 2 on the orbiting side consists of a orbiting outward curve 2*a* and a orbiting inward curve 2*b*. A center O of the orbiting scroll 1 is an origin of the orbiting outward curve 2*a* and the orbiting inward curve 2*b*. Here, in the volute body on the orbiting side, the orbiting outward curve 2*a* is such that an algebraic spiral represented by the following equation is brought to a basic or fundamental vortex curve, and an exponent k of the algebraic spiral is brought to k<1.0:

$$r=a\cdot\theta^{k} \tag{1}$$

where a: a coefficient of the algebraic spiral;

r:a radius vector (polar coordinate form); and

θ: an angle of deviation (polar coordinate form).

Further, a volute body 5 of the fixed scroll 4 is also formed similarly to the volute body 2 of the orbiting scroll 1. The volute body 5 of the fixed side consists of a fixed outward curve 5*a* and a fixed inward curve 5*b*. A center O' of the fixed scroll 4 is an origin of the fixed outward curve 5*a* and the fixed inward curve 5*b*. The fixed outward curve 5*a* is brought to a basis vortex curve in which the algebraic spiral represented by the equation (1) is rotated through 180° about the origin O'. The coefficient a of the algebraic spiral and the exponent k of the algebraic spiral are brought to values the same as those of the orbiting outward curve 2*a*.

The compressive action or function is executed as follows. That is, the volute body 5 on the fixed side is stationary, and the volute body 2 on the orbiting side is rotated at a orbiting radius e(=OO') without being rotated on its own axis about the center O' of the fixed scroll, whereby a plurality of closed working chambers 6, in the form of a crescent defined between the volute body 2 on the orbiting side and the volute body 5 on the fixed side, are defined as shown in FIG. 4. The working chambers 6 have respective volumes thereof which are reduced like (2), (3) and (4) as the revolution is advanced like 90°, 180° and 270°, from a condition (1) where suction of the fluid is ended through a-suction port which is provided on the side of an outer periphery of the fixed scroll 4, as shown in FIG. 4, so that the compressive action of the fluid is executed. The compressed fluid is finally discharged through a discharge port 7.

The volute body 2 on the orbiting side and the volute body 5 on the fixed side are arranged as described above, whereby a thickness t of the volute wall of each of the volute bodies can be continuously changed from the winding start to the winding end. It is possible to form a central portion of the volute body, where the pressure of the inside fluid, is brought to the highest pressure is thickened, and a winding end portion, where the inside fluid, is brought to low pressure is thinned. Thus, each portion of the volute wall of the volute body is brought to a uniform strength in accordance with the acting pressure. It is possible to reduce the volume of the volute body as compared with an involute curve or the like in which the thickness of the volute wall is constant. Thus, it is possible to reduce the material cost. Moreover, the thickness of the volute wall is so arranged as to be relatively thick in a region to about one winding from the winding start of the volute. Thus, it is possible to reduce internal leakage of the fluid.

Figure 5:
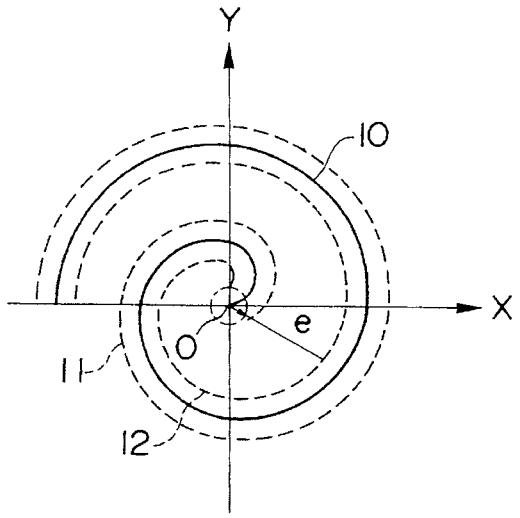
FIG. 5 is a schematic view for a forming method of a scroll shape or configuration according to the invention.
Figure 6:
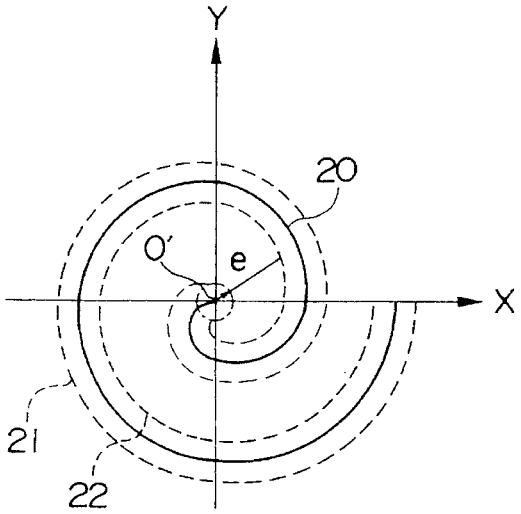
FIG. 6 is a schematic view for the forming method of the scroll configuration according to the invention.
Figure 7:
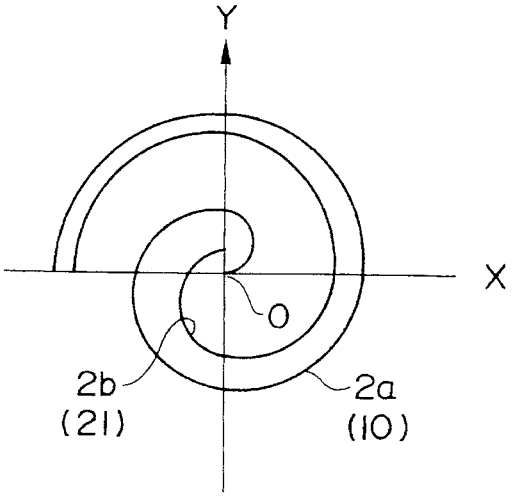
FIG. 7 is a schematic view for the forming method of the scroll configuration according to the invention.
Figure 8:
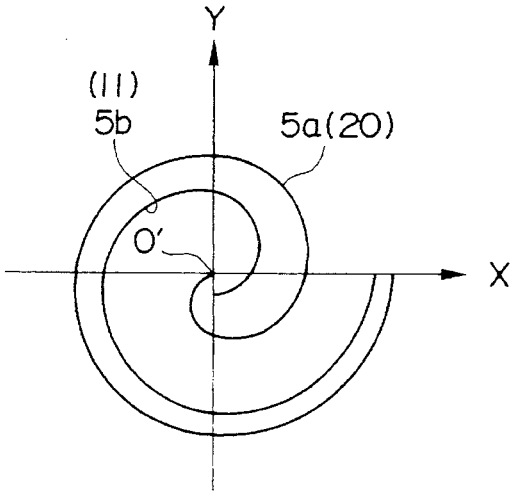
FIG. 8 is a schematic view for the forming method of the scroll configuration according to the invention.
Figure 9:
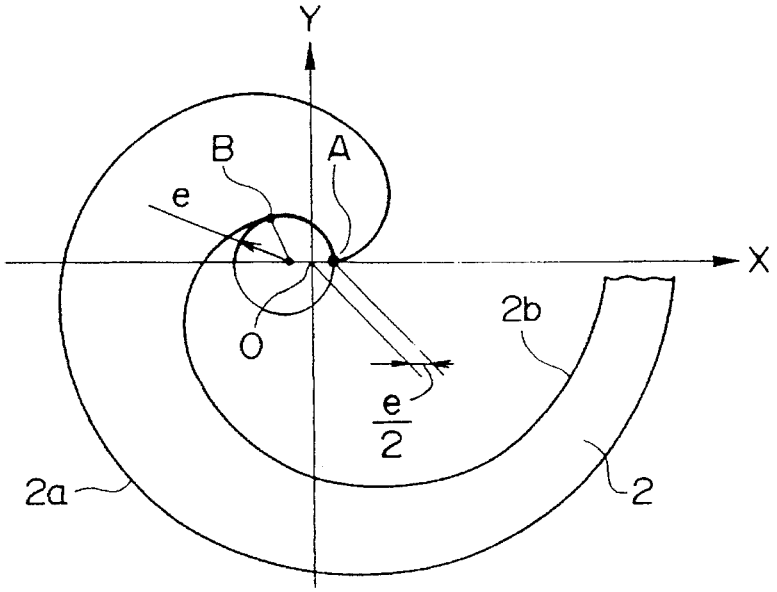
FIG. 9 is a schematic view for formation of a winding start portion of the scroll according to the invention.

FIGS. 5 and 6 show basic volute curves on the orbiting side and on the fixed side, and envelopes of circular loci drawn when the basic volute curves execute circular motion with a orbiting radius e, respectively. FIGS. 7 and 8 show arrangements of vortex curves on the orbiting side and on the fixed side, respectively. A solid line 10 is the basic volute curve on the orbiting side, and is an algebraic spiral expressed by the equation (1). The broken lines 11 and 12 are envelopes of the basic volute curve 10. The reference numeral 11 denotes the outward envelope, while the reference numeral 12 denotes the inward envelope. Further, a basic volute curve 20 on the fixed side represented by the solid line 20 is one in which the basic volute curve 10 on the orbiting side is angularly moved through 180° about the origin O. Broken lines 21 and 22 are envelopes of the basic volute curve 20. The reference numeral 21 denotes an outward envelope, while the reference numeral 22 denotes an inward envelope. Here, in order to bring the outward curve of the volute body to the basic volute curve, the solid line 10 is selected as the outward orbiting curve 2*a*, while the solid line 20 is selected as the outward fixed curve 5*a*. The inward curve of the volute element is decided as follows, in order that contact between both the volutes for preparing a plurality of sealed volumes is assured geometrically. That is, the outward envelope 21 of the basic volute curve 20 on the fixed side is selected because the orbiting inward curve 2*b* is in contact with the fixed outward curve 5*a*. The outward envelope 11 of the basic volute curve 10 on the fixed side is selected because the fixed inward curve 5*b* is in contact with the orbiting outward curve 2*a*. As described above, the basic vortex-curve forming method of each of the volute bodies has been described in which the thickness of the volute wall changes continuously in accordance with the winding angle of the volute. The arrangement of the winding start portion is required to satisfy such a condition that both the volute bodies do not interfere with each other when the volute body 2 on the orbiting side is moved in revolution about the volute body 5 on the fixed side, at the orbiting radius e. In view of this, an example of the arrangement of the winding staring portion will be described with reference to FIG. 9. In FIG. 9, a point K represents a start position of the orbiting outward curve 2*a*, while a point B represents a start position of the orbiting inward curve 2*b*. Here, the position of the point A is decided to a distance half the orbiting radius e from the origin O on the orbiting outward curve 2*a*, from a condition that both the volute bodies do not interfere with each other when the volute body 2 on the orbiting side is moved in revolution about the volute body 5 on the fixed side with the orbiting radius e. The point A corresponds to the point B on the orbiting inward curve 2*b* corresponding to the outward envelope 21 of the basic volute curve 20 on the fixed side, in FIGS. 5 to 8. An arc whose radius is the orbiting radius e passing through the point A is smoothly connected to the orbiting inward curve 2*b* at the point B. In this connection, a configuration of the winding start portion of the volute body on the fixed side is formed also similarly to that on the orbiting side.

Figure 10:
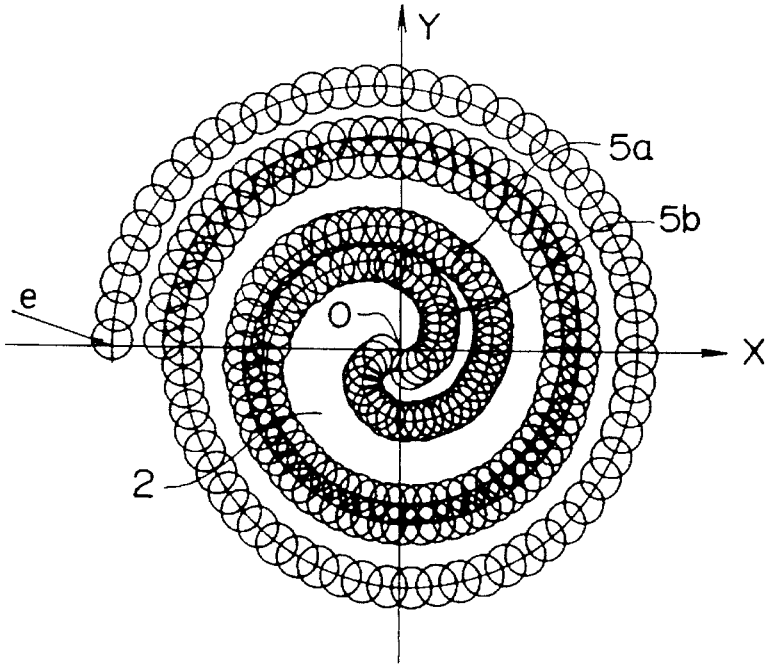
FIG. 10 is a schematic view of a locus of a cutter which processes the scroll configuration according to the invention.

FIG. 10 shows a locus of a cutter at the time the volute body on the orbiting side is formed. For example, the cutter (end mill or the like) whose radius is the orbiting radius e is used, and central coordinates of the cutter are moved along the outward curve 5*a* and the inward curve 5*b* of the volute body 5 on the fixed side, whereby the volute body 2 on the orbiting side is processed continuously. Thus, dimensional accuracy of the volute body is improved so that it is possible to efficiently process the volute body. In a case where the volute body 5 on the fixed side is processed, the cutter center is reversely moved along the vortex curve of the volute body 2 on the orbiting side, whereby processing is executed similarly.

Figure 11:
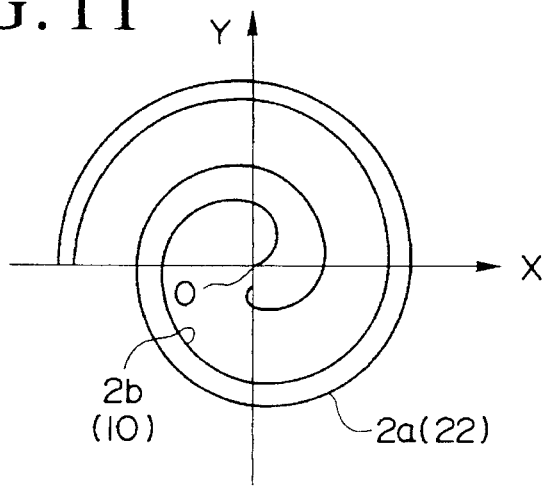
FIG. 11 is a schematic view for the forming method of the scroll configuration according to the invention.
Figure 12:
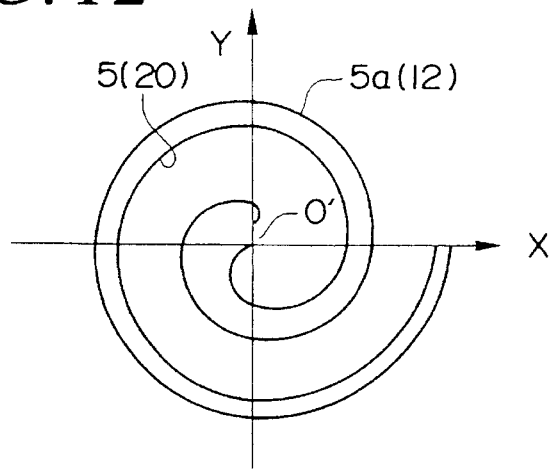
FIG. 12 is a schematic view for the forming method of the scroll configuration according to the invention.
Figure 13:
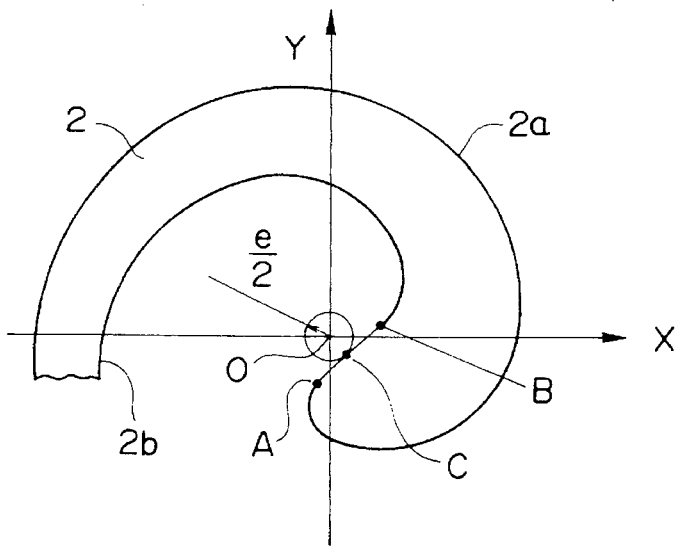
FIG. 13 is a schematic view for the formation of the winding start portion of the scroll according to the invention.

The method of forming the volute body at the time the outward curve of the volute body is brought to the basic volute curve has been described above. A method of forming a volute body at the time the inward curve of the volute body is brought to the basic volute curve will next be described. FIGS. 11 and 12 show vortex curves on the orbiting side and on the fixed side, respectively. In this case, since the inward curve of the volute body is the basic volute curve, the solid line 10 in FIG. 5 is selected as the orbiting inward curve 2*b*, while the solid line 20 in FIG. 6 is selected as the fixed inward curve 5*b*. The outward curve of the volute body is determined as follows. Since the orbiting outward curve 2*a* is in contact with the fixed inward curve 5*b*, the inward envelope 22 of the basic volute curve 20 on the fixed side in FIG. 5 is selected, while the inward envelope 12 of the basic volute curve 10 on the fixed side in FIG. 5 is selected since the fixed outward curve 5*a* is in contact with the orbiting inward curve 2*b*, whereby contact between both the volutes for forming a plurality of sealed volumes is assured geometrically. Moreover, the winding start portion of the volute body at this time is formed as shown in FIG. 13, differentiated from a case (FIG. 9) where the outward curve of the aforesaid volute body is brought to the basic volute curve. In FIG. 13, the point A represents a start position of the orbiting outward curve 2*a* forming the volute body 2 on the orbiting side, while the point B represents the start position of the orbiting inward curve 2*b*. The positions of the respective points A and B are decided such that a circle whose radius is half the orbiting radius e is drawn about the origin O, and the points A and B are connected to each other by a straight line which passes through a single point C on the circle and by which the orbiting outward curve 2*a* and the orbiting inward curve 2*b* are smoothly connected to each other. The configuration of the orbiting start portion of the volute body on the orbiting side has been described above. However, the volute body on the fixed side is also formed similarly to that on the orbiting side.

Figure 14:
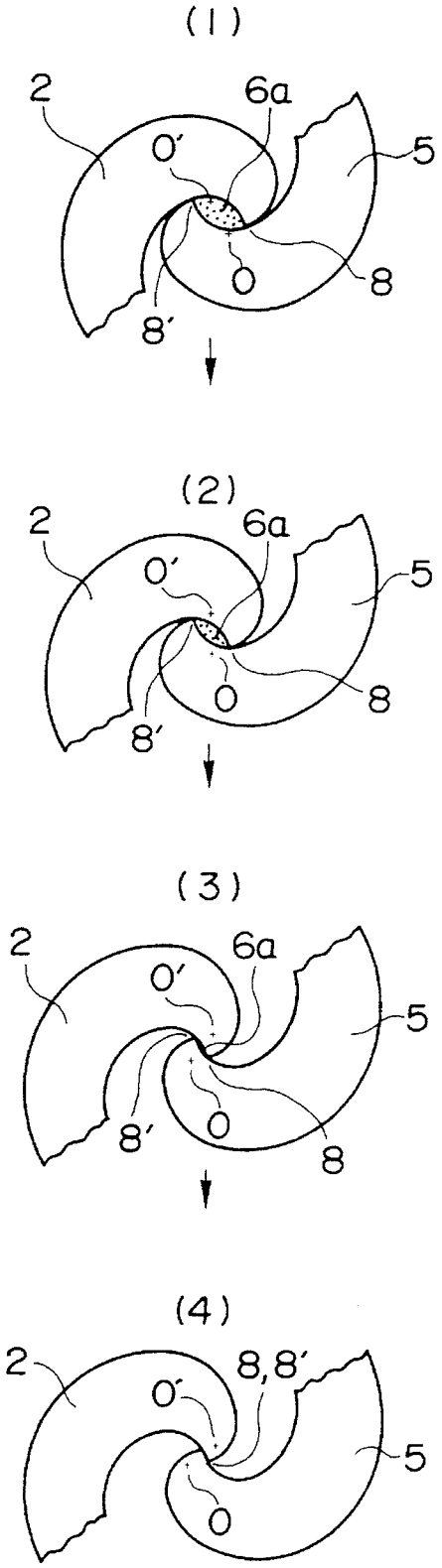
FIG. 14 is an enlarged schematic view of a portion, showing a meshing condition between central portions of respective volute bodies according to the invention.

The method of forming the volute body in which the thickness of the volute wall changes continuously in accordance with the winding angle of the volute has been described above. The volute body of the present embodiment, however, has a superior advantage that a top clearance volume is brought to zero, and there is no loss in keeping with re-expansion of the fluid within the top clearance, which is absent in a conventional involute curve. FIG. 14 depicts a meshing condition between central portions of the respective volute bodies, in an operational principle view of the scroll compressor according to the embodiment illustrated in FIG. 4. As shown in FIG. 14, an innermost chamber 6*a* formed by innermost contact points 8 and 8' of the volute body 2 on the orbiting side and the volute body 5 on the fixed side is such that, when the volute body 2 on the orbiting side is relatively moved in revolution about the volute body 5 on the fixed side at the orbiting radius e (=OO'), the volume of the innermost chamber 6*a* formed by the contact points 8 and 8' is reduced in order of (1), (2), (3) and (4) in FIG. 14, and the top clearance volume which has conventionally been existed is brought to zero. For this reason, the compressed fluid is all discharged through the discharge port (not shown) to the outside without occurrence of wasteful re-expansion. In this connection, although omitted from FIG. 14, it is required to form the discharge port at a location in communication with the innermost chamber 6*a*. Accordingly, the volume of the discharge port portion is brought to the top clearance volume. However, this quantity is extremely low or small as compared with a conventional one, and can be regarded substantially as zero. Here, formation of the winding start portion of the volute body has been described regarding one illustrated in FIG. 9. Also regarding formation of the winding start portion as illustrated in FIG. 13, however, the top clearance volume is similarly brought to zero, although description thereof will be omitted.

The scroll compressor arranged in this manner is applied to the refrigerant cycle or a cycle exclusive for cooling. Accordingly, internal leakage of the fluid between the volute bodies can be reduced, and the top clearance volume is also brought to zero. In this manner, efficiency of the compressor is considerably improved. Thus, there can be provided a refrigeration air conditioning system which is superior in energy efficiency and high in reliability.

A second embodiment of the invention will next be described with reference to FIGS. 15 to 18. In the embodiment of FIGS. 1–10, a case has been indicated where the basic vortex curves of the respective volute bodies are brought to the algebraic spiral expressed by the equation (1), the exponent k of the algebraic spiral is brought to $k < 1.0$, and the coefficient a of the algebraic spiral is also brought to any optional constant. However, the basic volute curves are selected such that the coefficient a of the algebraic spiral or the exponent k of the algebraic spiral expressed in the equation (1) is brought to a function of the angle of deviation θ, whereby it is possible to suitably change the thickness of the volute wall. Thus, each of the volute bodies can be miniaturized less than the involute curve, while the strength of the volute body is manufactured. In this case, the exponent k of the algebraic spiral is not limited to a region of $k<1.0$.

Figure 15:
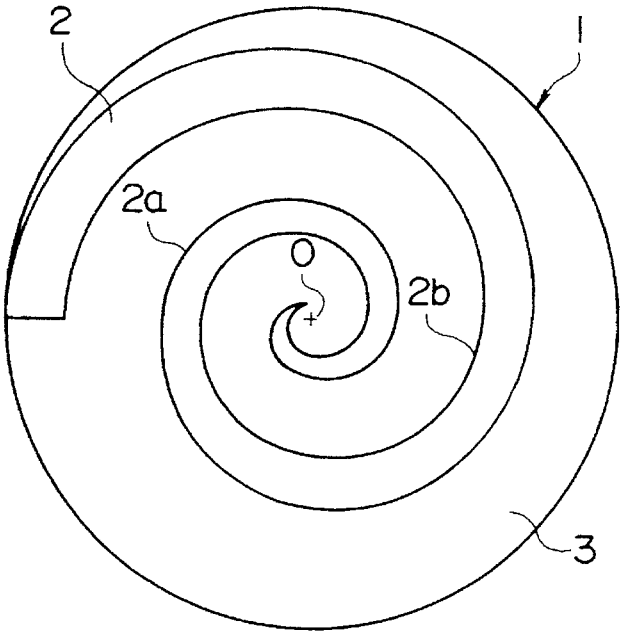
FIG. 15 is a top plan view of a scroll configuration in accordance with a second embodiment of the invention.
Figure 16:
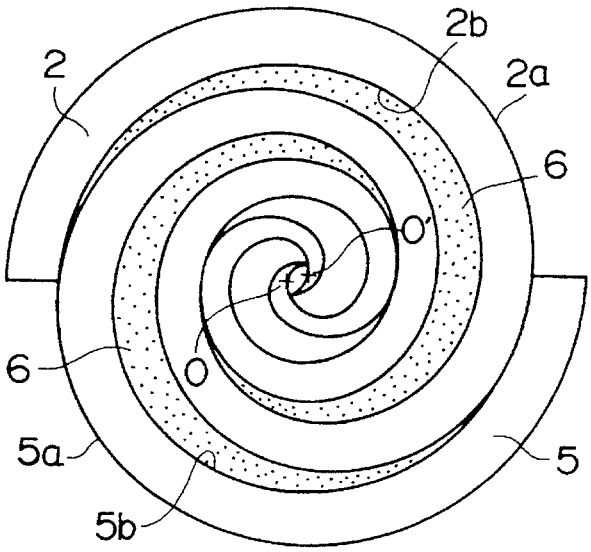
FIG. 16 is a top plan view of the scroll configuration of the embodiment of FIG. 15.
Figure 17:
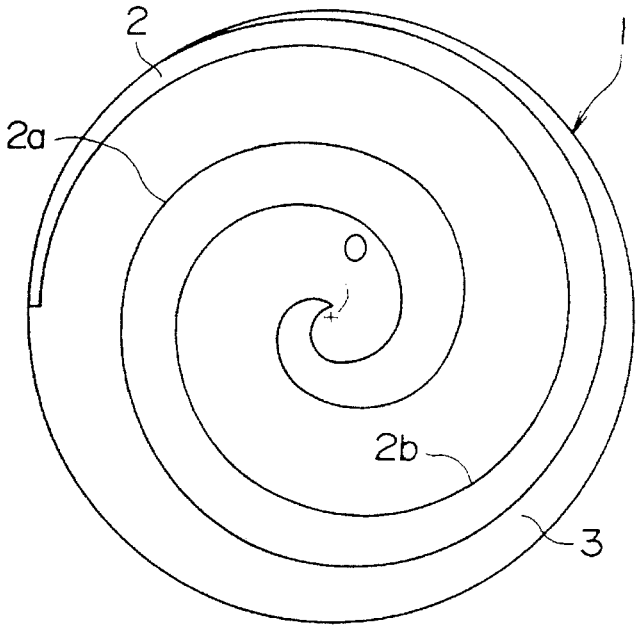
FIG. 17 is a top plan view of the scroll configuration of another embodiment of the invention.
Figure 18:
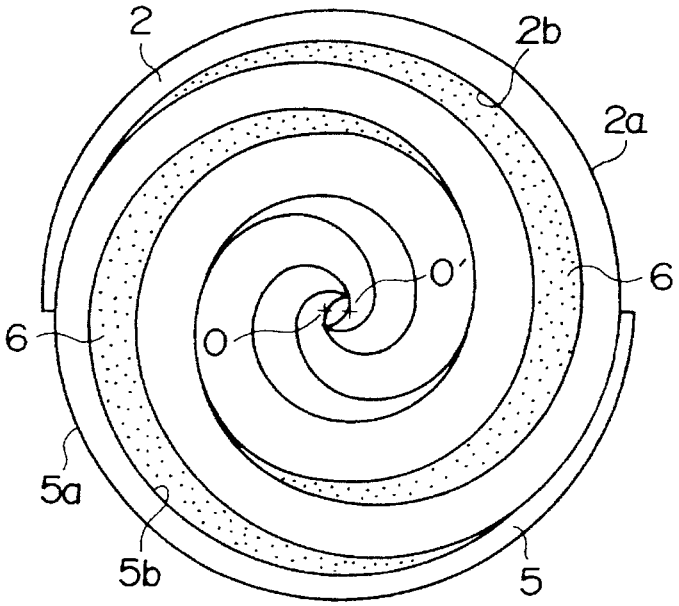
FIG. 18 is a top plan view of the scroll configuration of embodiment of FIG. 17.
Figure 19:
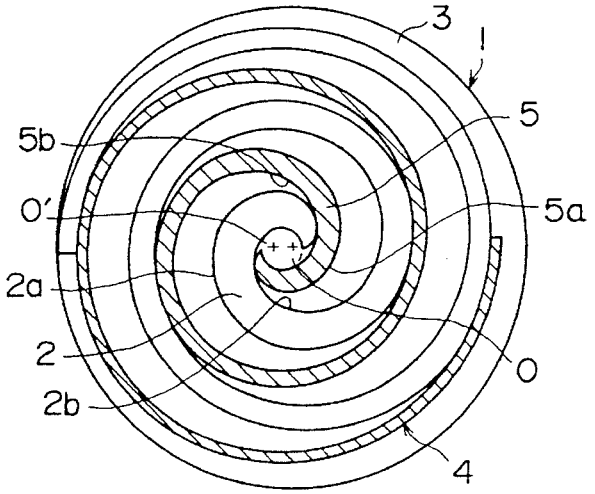
FIG. 19 is a partial cross-sectional top plan view of a scroll configuration of yet another embodiment of the invention.

FIGS. 15 and 16 show a scroll configuration where the basic volute curve of each of the volute bodies is brought to an algebraic spiral expressed by the equation (1), the exponent k of the algebraic spiral is brought to a constant of k>1.0, and the coefficient a of the algebraic spiral is also brought to a constant. FIG. 15 shows a orbiting scroll, while FIG. 16 shows an arrangement of the volute bodies at the time of completion of suction (compression start) in a case where the volute bodies are used as the compressor. Similarly to FIGS. 15 and 16, FIGS. 17 and 18 show a scroll configuration in a case where the exponent k of the algebraic spiral is brought to k<1.0, and the coefficient a of the algebraic spiral is brought to a constant value the same as that in FIGS. 14 and 15, but the algebraic spiral in which the exponent k is expressed by a function of the angle of deviation θ is brought to the basic volute curve. Specifically, the exponent k is a linear function of the angle of deviation θ, and a value of k is reduced linearly from the winding start to the winding end. As will be clear from comparison between FIG. 14 and FIG. 15, in FIGS. 15 and 16 in which the exponent k of the algebraic spiral is brought to a constant of k<1.0, the more a location approaches the central portion (winding start) of the volute, the less the thickness of the volute wall is thinned or reduced, so that this is apt to become a problem. This, however, can be applied to a case where the pressure difference is small or low. On the contrary, the more a location approaches the outer periphery of the volute, the more the thickness of the volute wall increases or is thickened. Accordingly, in a case where an outer configuration is constant, the volumes (stroke volumes) of the respective outermost working chambers 6 and 6 are reduced. On the contrary, in FIGS. 17 and 18 in which the exponent k of the algebraic spiral is changed in dependence upon the winding angle of the volute, the exponent k is k>1.0. However, the thickness of the volute wall of the winding start portion is secured to such a degree that the strength is out of the equation. At the outer periphery of the volute, similarly to a case where the exponent k of the algebraic spiral is k<1.0, the more a location approaches the winding end portion, the less the thickness of the volute wall is thinned or reduced so that the stroke volume increases. As a result of detailed numerical analysis, it is found that, if it is assumed that the outer configuration (a diameter and a height of the volute) is constant, the volute body shown in FIGS. 15 and 16 increases about thirty percent in stroke volume, as compared with the volute body shown in FIGS. 17 and 18, and an internal volume ratio also increases from 2.71 of the former to 2.80 of the latter. Accordingly, in a case where the stroke volume and the internal volume ratio become constant, it is possible to miniaturize or reduce in size the volute body. Here, a case where the exponent k is changed in accordance with the linear function of the angle of deviation θ is shown. However, the exponent k may be given by a quadratic, cubic or logarithmic function of the angle of deviation θ. Alternatively, even if the exponent k is a constant and the coefficient a of the algebraic spiral is changed by a function of the angle of deviation θ, it is possible to suitably change the thickness of the volute wall similarly. It is possible to miniaturize or reduce in size the volute body less than the involute curve, while the strength of the volute body is secured. Thus, it is possible to produce the scroll compressor which reduces internal leakage of the fluid to improve performance.

A scroll configuration of the embodiment of FIGS. 19–30 is formed similarly to the scroll configuration shown in the embodiment of FIGS. 1–10. However, in the embodiment of FIGS. 19–30, the orbiting scroll and the fixed scroll formed of a different material from each other. For example, the orbiting scroll is made of a light-weight low-strength material such as an aluminum alloy or the like, while the fixed scroll is made of a common iron material higher in strength than the orbiting scroll. In the embodiment of FIGS. 19–30, the volute body 2 on the orbiting side, made of a low strength material is formed thick in thickness of the volute wall as a whole, as compared with the volute body 5 on the fixed side higher in strength. Setting is made such that both are brought to respective strengths thereof substantially similar to each other. However, an outward curve and an inward curve of the respective volute bodies of the orbiting scroll and the fixed scroll, origins O and O' of the volute curves and an exponent k of the algebraic spiral are set similarly to the embodiment of FIGS. 1–10.

However, in order that the algebraic spiral represented by the equation (1) is thickened more than the thickness of the volute wall, the arrangement of the volute body 2 on the orbiting side is such that the orbiting outward curve 2*a* is rotated through an angle α about a center of the origin O to be described subsequently, so as to be brought to a basic volute curve. By doing so, both the thicknesses of the volute walls of the respective volute body 2 on the orbiting side and volute body 5 on the fixed side are continuously changed from the winding start of the volute to the winding end thereof. A central portion of the volute body where the pressure of the internal fluid is brought to the highest pressure is thick, and is thin at the winding end portion where the pressure of the internal fluid is brought to low pressure. It is possible to reduce the volume of each of the volute bodies as compared with the involute curve or the like in which the thickness of the volute wall is constant. Thus, it is possible to reduce the material cost, and to reduce the weight. In a region from the winding start of the volute through one winding, the thickness of the volute wall is so arranged as to increase or so as to be thickened relatively, so that it is possible to reduce the internal leakage of the fluid. Moreover, the volute body 2 on the orbiting side, made of a low strength material, is arranged such that the thickness of the volute wall is thickened as a whole as compared with the volute body 5 on the fixed side higher in strength, so that both the volute body 2 on the orbiting side and the volute body 5 on the fixed side are brought to respective strengths thereof which are substantially equal to each other.

Figure 20:
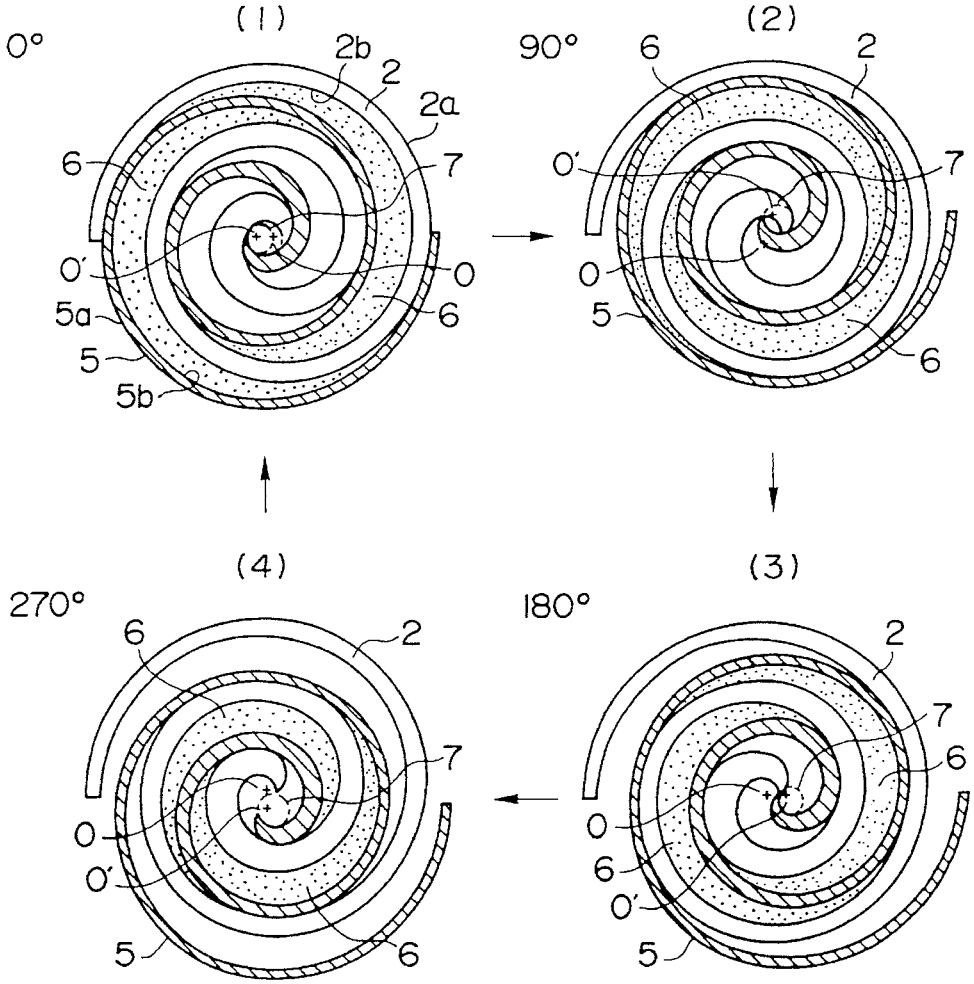
FIG. 20 is a schematic partial cross-sectional view depicting an operational principle of a scroll compressor.

As shown in FIG. 20, similarly to the embodiment FIGS. 1–10, the volute body 5 on the fixed side is stationary, while the volute body 2 on the orbiting side is moved in revolution at a orbiting radius e (=OO') without being revolved about its own axis about the center O' of the fixed scroll, whereby a plurality of crescent-shaped closed spaces and a pair of working chambers 6 and 6 are defined between the two volute bodies 2 and 5. The volumes of the respective working chambers 6 and 6 are reduced like (2), (3) and (4) as the revolution advances like 90°, 180° and 270° from a condition (1) under which suction of the fluid is completed. Thus, a compressive action of the fluid is executed.

Figure 21:
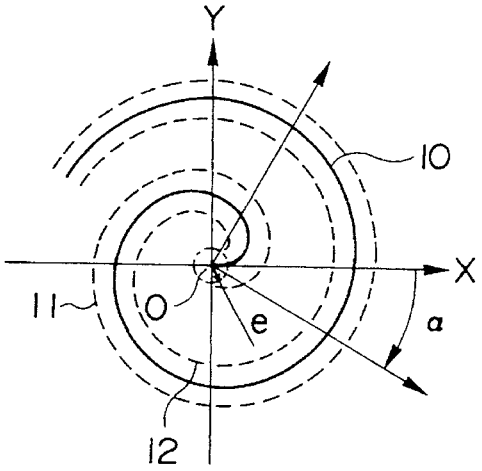
FIG. 21 is a diagrammatic view depicting a forming method of the scroll configuration according to the invention.
Figure 22:
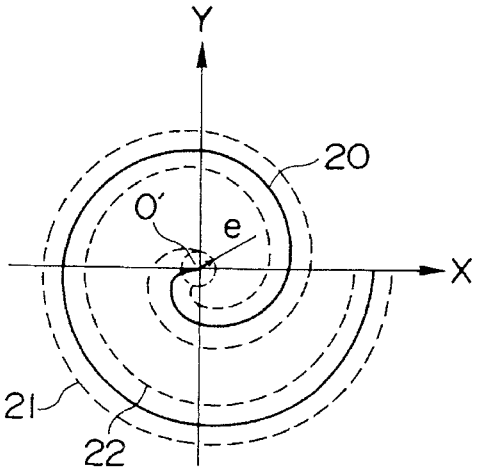
FIG. 22 is a diagrammatic view depicting the forming method of the scroll configuration according to the invention.
Figure 23:
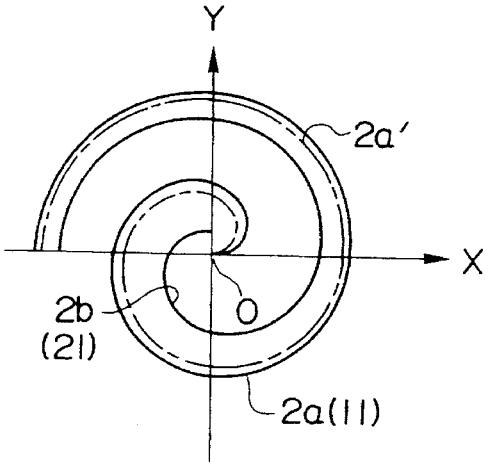
FIG. 23 is a schematic plan view depicting the forming method of the scroll configuration according to the invention.
Figure 24:
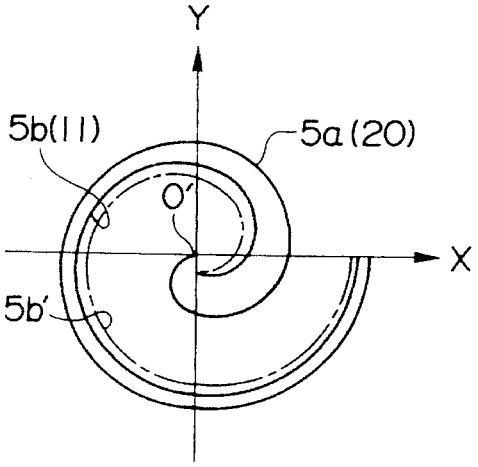
FIG. 24 is a schematic plan view depicting the forming method of the scroll configuration according to the invention.
Figure 25:
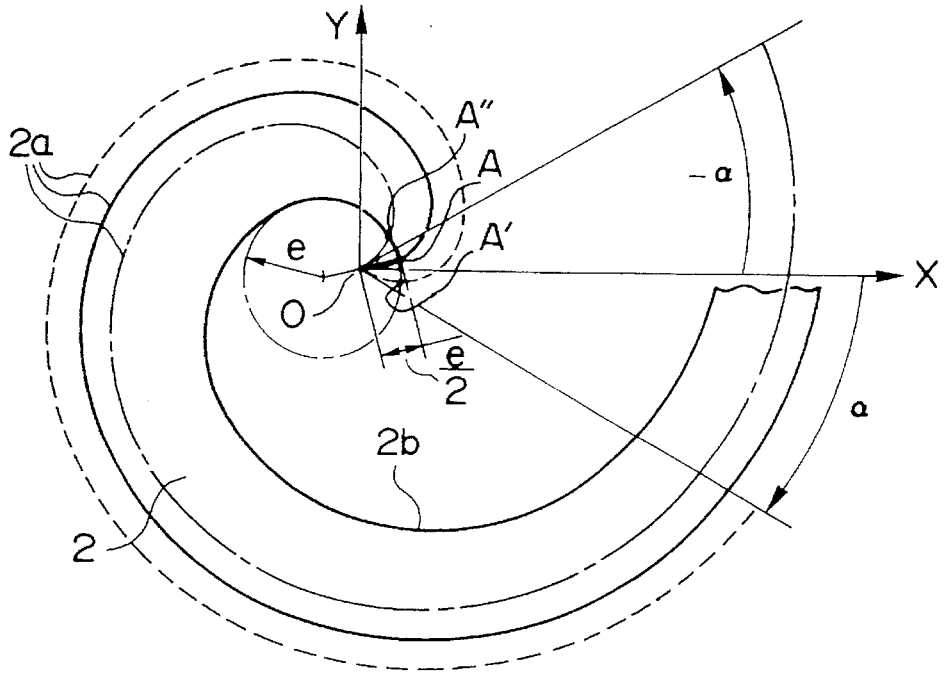
FIG. 25 is a top plan view depicting an arrangement of a winding start portion of a orbiting scroll according to the invention.
Figure 26:
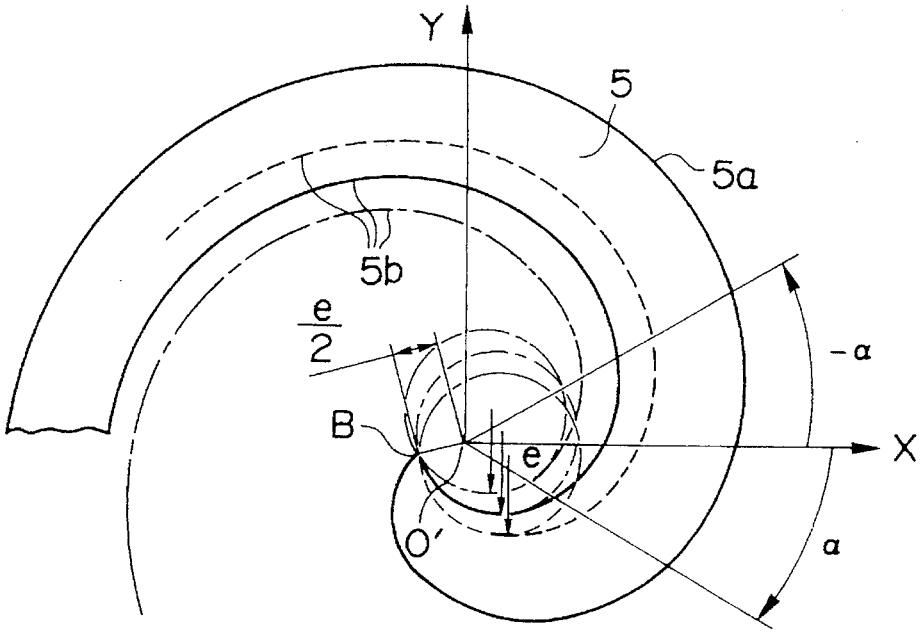
FIG. 26 is a top plan view showing an arrangement of a winding start portion of a fixed or stationary scroll according to the invention.

A method of forming the volute body 2 on the orbiting side and the volute body 5 on the fixed side, according to the present invention, will next be described in detail with an example cited when the outward curve of the volute body is taken as a basic volute curve. FIGS. 21 and 22 show basic volute curves on the orbiting side and on the fixed side, and an envelope of a circular locus drawn at the time the basic volute curves are moved in circle at a orbiting radius e, respectively. FIGS. 23 and 24 show arrangements of the vortex curves on the orbiting side and on the fixed side, respectively. The solid line 10 is the basic volute curve on the orbiting side, and is one in which the algebraic spiral represented by the equation (1) is rotated only through an angle α around the origin O. The broken lines 11 and 12 are envelopes of the basic volute curve 10. The reference numeral 11 denotes the outward envelope, while the reference numeral 12 denotes an inward envelope. Further, the solid line 20 is a basic volute curve on the fixed side, and this curve is one in which the basic volute curve 10 on the orbiting side is rotated through (180–α)° about the origin O. The broken lines 21 and 22 are envelopes of the basic volute curve 20. The reference numeral 21 denotes an outward envelope, while the reference numeral 22 denotes an inward envelope. Similarly to the embodiment of FIGS. 1–10, since the outward curve of each of the volute bodies is the basic volute curve, the solid line 10 is selected as the orbiting outward curve 2*a*, and the solid line 20 is selected as the fixed outward curve 5*a*. The inward curve of each of the volute bodies is determined as follows, in order to geometrically assure contact between both the volutes for forming the plurality of closed volumes. Further, since the orbiting inward curve 2*b* is in contact with the fixed outward curve 5*a*, the outward envelope 21 of the basic vortex curve 20 on the fixed side is selected. Since the fixed inward curve 5*b* is in contact with the orbiting outward curve 2*a*, the outward envelope 11 of the basic volute curve 10 on the fixed side is selected. Here, a orbiting outward curve 2*a'* and a fixed inward curve 5*b'* indicated by a one-dot-and-chain line are a case where the angle α is 0°, and correspond to a case corresponding to the first embodiment. In a case of the present embodiment, however, the basic volute curve 10 on the orbiting side and the basic volute curve 20 on the fixed side are the same in configuration as each other, and are shifted in phase by (180–α)°. Accordingly, differentiated from the scroll configuration indicated in the embodiment of FIGS. 1–10 in which the phase difference is 180°, it is possible to change the thickness of each of the volute walls on the fixed side and on the orbiting side. Further, since the inward curve and the outward curve are not coincident with each other at the winding start of each of the volute bodies, the winding start portion is determined similarly to the embodiment of FIGS. 1–10, as shown, for example, in FIGS. 25 and 26. FIG. 25 shows an arrangement of the winding start portion at the time the orbiting outward curve 2*a* that is the basic volute curve is rotated (through the angle α), in the volute body 2 on the orbiting side, while FIG. 26 shows the arrangement of the winding start portion of the volute body 5 on the fixed side, which is in mesh with the volute body 2 on the orbiting side. In the vortex curves illustrated in FIGS. 25 and 26, the solid line indicates non-rotation (α=0°). The broken line indicates the orbiting outward curve 2*a* being rotated through −α° in a clockwise direction (hereinafter referred to as "a positive direction") about the origin O. The one-dot-and-chain line indicates a case where the orbiting outward curve 2*a* is rotated through −α° in a counterclockwise direction (hereinafter referred to as "a negative direction"). In this manner, the orbiting outward curve 2*a* (solid line) consisting of the algebraic spiral expressed by the equation (1) is rotated through α°, whereby the thickness of the volute wall of the volute body 2 on the orbiting side is thickened or increases, while the thickness of the volute wall of the volute body 5 on the fixed side is thinned or is reduced. Reversely, in a case of being rotated through −α°, the thickness of the volute wall of the volute body 2 on the orbiting side is thinned or is reduced, while the thickness of the volute wall of the volute body 5 on the fixed side is thickened or increases.

It is required that the arrangement of the winding start portion satisfies a condition that both the volute bodies do not interfere with each other when the volute body 2 on the orbiting side is moved in revolution about the volute body 5 on the fixed side with the orbiting radius e. In accordance with the invention, however, a method is provided wherein the inward curve and the outward curve are connected to each other by a single arc. In the volute body 2 on the orbiting side illustrated in FIG. 25, the orbiting inward curve 2*b* and the orbiting outward curve 2*a* are smoothly connected to each other by an arc whose radius is the orbiting radius e passing through the point A which is located at a half distance of the orbiting radius e from the origin O on the orbiting outward curve 2*a*. In the volute body 5 on the fixed side illustrated in FIG. 26, the fixed inward curve 5*b* and the fixed outward curve 5*a* are smoothly connected to each other by an arc whose radius is the orbiting radius e passing through the point B which is located at a half distance of the orbiting radius e from the origin O' on the fixed outward curve 5*a*. In this connection, a central location of the arc at this time is changed by the angle of rotation α, and this coordinates correspond to points A, A' and A" in FIG. 22.

Figure 27:
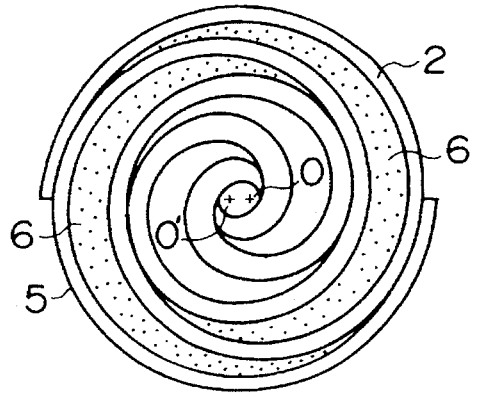
FIG. 27 is a top plan view showing a change in scroll configuration wherein an angle $\alpha$ is provided.
Figure 28:
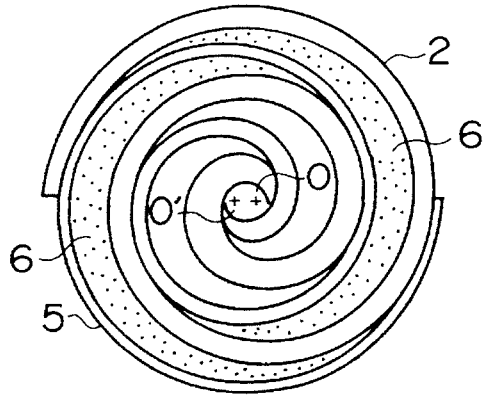
FIG. 28 is a top plan view showing the change in scroll configuration wherein the angle $\alpha$ is provided.
Figure 29:
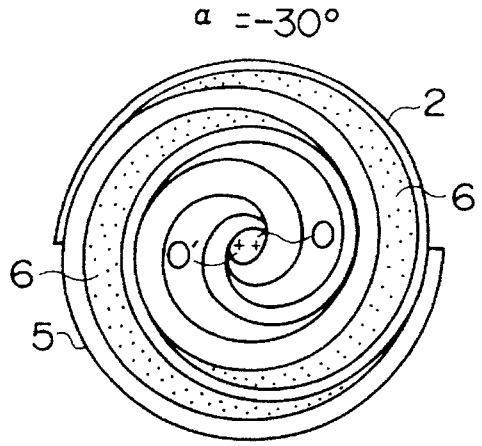
FIG. 29 is a top plan view showing the change in scroll configuration wherein the angle $\alpha$ is provided.

As will be seen from FIGS. 27 to 29 showing a change of the scroll configuration due to a change in rotational angle α, the thicknesses of the respective volute walls of the volute body 2 on the orbiting side and the volute body 5 on the fixed side are changed by a value of the angle α. It will be seen from FIGS. 28 and 29 that, in a case where the angle α is the same value but the directions (corresponding to the rotational direction) are different from each other, the configurations of the volute body 2 on the orbiting side and the volute body 5 on the fixed side are just replaced by each other. Furthermore, the stroke volume is the same in area as a case of being not rotated, of α=0° illustrated in FIG. 27, as will be seen from comparison with an area of the working chamber 6 at completion of suction. It is possible to adequately or suitably change the thicknesses of the respective volute walls on the fixed side and on the orbiting side in accordance with used material. Similar to the embodiment of FIGS. 1–10, there is an advantage to miniaturize or reduce in size the volute body less than the involute curve. In this connection, here, an example in which the outward curve of the volute body 2 on the orbiting side is rotated is cited. However, a similar arrangement can be realized if the volute body 5 on the fixed side is rotated.

Figure 30:
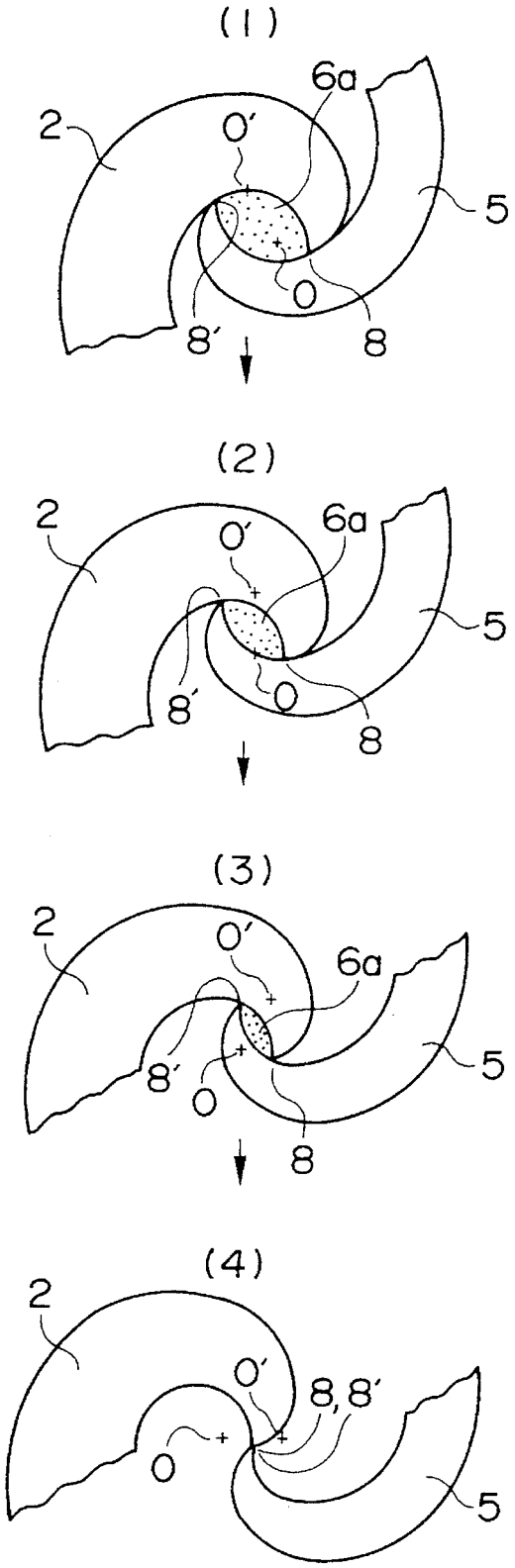
FIG. 30 is a top plan view depicting a meshing condition between central portions of respective volute bodies.

In connection with the above, the method of generating the volute body in the present embodiment is similar to that described with reference to the first embodiment. Moreover, as shown in FIG. 30 showing in enlargement the meshing condition between the central portions of the respective volute bodies, the top clearance volume is brought to zero in the volute body of the present embodiment, similarly to the first embodiment. Thus, the embodiment of FIGS. 19–30 has a superior advantage that there is no loss in keeping with the re-expansion of the fluid within the top clearance. That is, in FIG. 30, the innermost chamber 6*a* defined by the innermost contact points 8 and 8' between the volute body 2 on the orbiting side and the volute body 5 on the fixed side is such that, as will be apparent from FIG. 30, when the volute body 2 on the orbiting side is moved in revolution relatively about the volute body 5 on the fixed side with the orbiting radius e (=OO'), the volume of the innermost chamber 6*a* defined by the contact points 8 and 8' is reduced in order of (1), (2), (3) and (4) illustrated in FIG. 30, so that the top clearance volume is brought to zero. For this reason, the compressed fluid is all discharged to the outside through a discharge port (not shown) without causing wasteful re-expansion. In this connection, although omitted from FIG. 24, it is in fact required that the discharge port is formed at a location in communication with the innermost chamber 6*a*. Accordingly, the volume of the discharge port is brought to the top clearance volume. However, this volume is small as compared with the stroke volume, and can be regarded as being substantially zero.

As described above, in the present embodiment, the description has been made only to the arrangement of the winding start portion of the volute body illustrated in FIGS. 25 and 26. However, it is also possible that the top clearance volume is brought similarly to zero also by an arrangement of a winding start portion to be described subsequently, other than the above.

Figure 31:
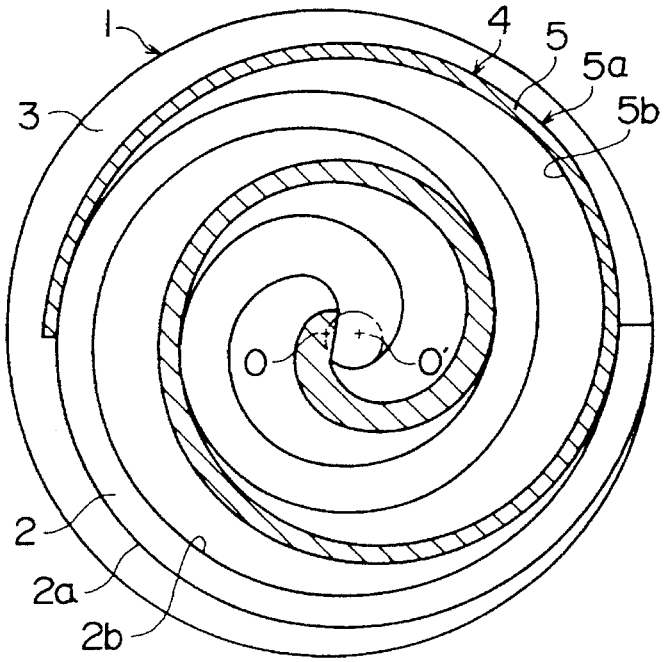
FIG. 31 is a top plan view depicting the meshing condition between the central portions of the respective volute bodies.

The method of arranging the volute bodies different in thickness of the volute wall from each other at the time the outward curve of the vortex body is brought to the basis vortex curve has been described above. However, also when the inward curve of the volute body is brought to the basic volute curve, a similar arrangement is made possible by the fact that the orbiting inward curve 2*b* or the fixed inward curve 5*b* is changed through the adequate or suitable angle $\alpha$ such that the orbiting inward curve 2*b* of the volute body 2 on the orbiting side and the fixed inward curve 5*b* of the volute body 5 on the fixed side, that are the basic volute curves are brought approximately to 180° in phase difference. As an example, FIG. 26 shows a scroll configuration at the time the algebraic spiral expressed by the equation (1) is rotated through $\alpha=-30°$ about the origin O so as to be brought to the orbiting inward curve 2*b* (the basic volute curve of the volute body 2 on the orbiting side), and the fixed inward curve 5*b* (the basic volute curve of the volute body on the fixed side) is $(180-\alpha)°$ in phase difference with respect to the orbiting inward curve 2*b*. In a case where the inward curve is the basic volute curve, an affection or influence of the rotation (the angle $\alpha$) appears reversely with respect to a case where the outward curve is the basic volute curve as shown in FIG. 31. The arrangement is such that, at $\alpha=-30°$ the thickness of the volute wall of the volute body 2 on the orbiting side is thickened or increases, and the thickness of the volute wall of the volute body 5 on the fixed side is thinned, similarly to a case of $\alpha=30°$ in FIG. 28.

With the arrangement in this manner, in a case where materials of the volute bodies are different from each other, it is possible to bring various parts of the volute bodies to a similar strength. Miniaturization or reduction in size reduces the bearing load. Thus, reliability of the compressor can be improved.

In the embodiment of FIGS. 32–35, a case has been indicated where the respective basic volute curves of the volute body 2 on the orbiting side and the volute body 5 on the fixed side are essentially expressed by the same numerical equations although they are rotated, the algebraic spiral expressed by the equation (1) is basic, the exponent k of the algebraic spiral is $k<1$, and the coefficient a of the algebraic spiral is also set to an optional constant. However, the invention should not be limited to this specific arrangement. Hereunder, as shown in the embodiment of FIGS. 32–35, for example, although the coefficient a of the algebraic spiral or the exponent k of the algebraic spiral expressed by the equation (1) is brought to a function of the angle of deviation $\theta$, it is suitably possible to change the thickness of the volute wall. The volute body can be reduced in size less than the involute curve, while securing the strength of the volute body. In this case, the exponent kk of the algebraic spiral is not limited to the region of $k<1.0$. Furthermore, the basic volute curve of each of the volute body 2 on the orbiting side and the volute body 5 on the fixed side may be formed by a different curve.

Figure 32:
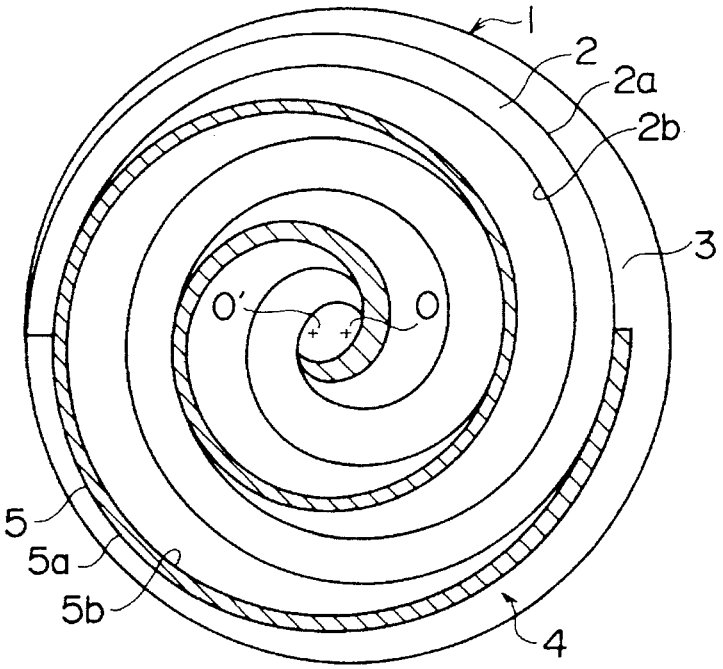
FIG. 32 is a top plan view of a scroll configuration, showing another embodiment of the invention.
Figure 33:
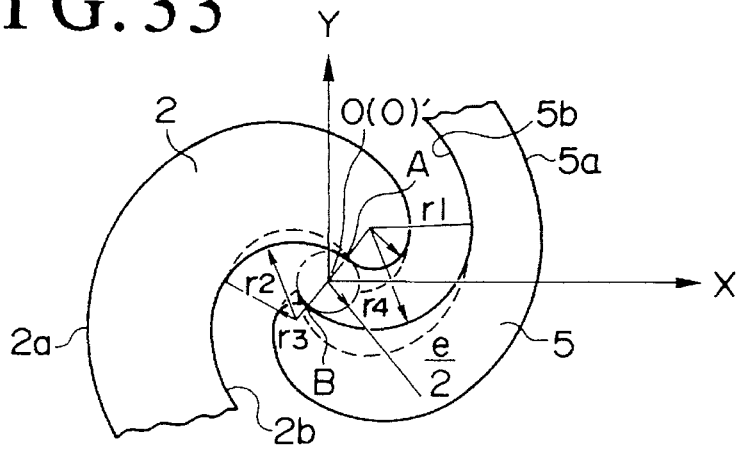
FIG. 33 is a top plan view showing an arrangement of a winding start portion of the embodiment of FIG. 32.
Figure 34:
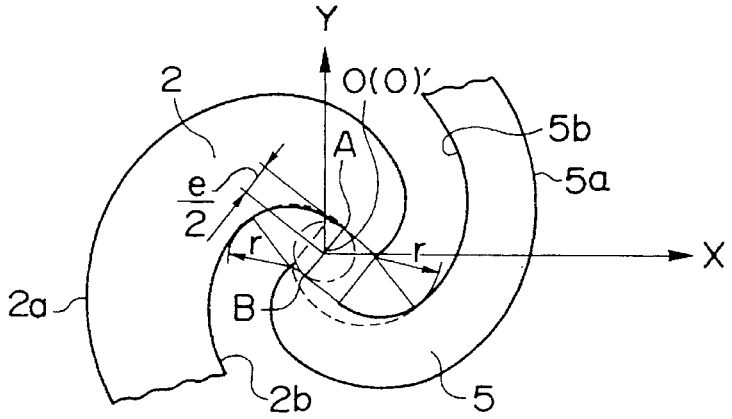
FIG. 34 is a top plan view showing the arrangement of the winding start portion of the invention.
Figure 35:
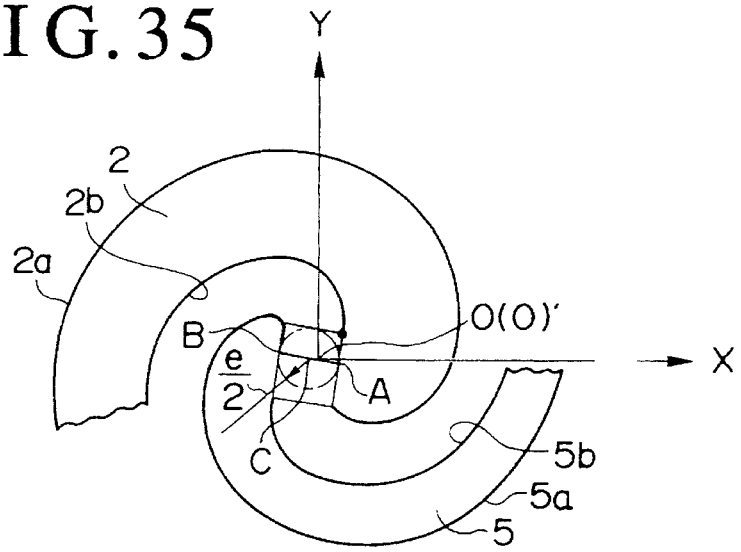
FIG. 35 is a top plan view showing the arrangement of the winding start portion of the invention.

As shown in FIG. 32, the outward curve of the volute body is brought to the basic volute curve, the outward curve 2*a* of the volute body 2 on the orbiting side and the outward curve 5*a* of the volute body 5 on the fixed side are formed by the algebraic spiral expressed by the equation (1), and the exponent k of the algebraic spiral and the coefficient a of the algebraic spiral are formed by values different from each other. In this case, it is not required to rotate the volute curve, and the two basic volute curves different from each other are suitably selected, whereby it is possible to form a volute body which produces advantages similar to those of the volute body illustrated in FIG. 19. In FIGS. 25 and 26, the arrangement of the winding start portion has been described in which the single arc at the time the outward curve of the vortex body is taken as the basic volute curve is brought to the connecting curve. However, the arrangement of the winding start portion of the invention should not be limited to this specific arrangement, but various arrangements can be considered other than the above. Other arrangements of the winding start portion of the volute body arranged as described above will be described with reference to FIGS. 33, 34 and 35. FIGS. 33 and 34 show a case where the outward curve of the volute body is taken as the basic volute curve, while FIG. 35 shows a case where the inward curve of the volute body is taken as the basic volute curve as shown in FIG. 31. In FIGS. 33 to 35, the volute body 2 on the orbiting side and the volute body 5 on the fixed side are expressed by the same x - y coordinate axes. FIG. 33 shows a case where the connecting curve at the winding start portion is formed by two arcs, and a case where the broken line is the single arc illustrated in FIGS. 25 and 26. The volute body 2 on the orbiting side is such that the outward curve 2*a* and the inward curve 2*b* are connected to each other by two arcs including r1 and r2. The volute body 5 on the fixed side is such that the outward curve 5*a* and the inward curve 5*b* are connected to each other by two arcs including r3 and r4. Connecting points A and B between the arcs are in contact with a circle whose radius is half the orbiting radius e from the origin O (or O'). Central coordinates of the arcs r1 and r4 and the arcs r2 and r3 are the same as each other. FIG. 34 forms the winding start portion by the arc and the linear or straight line, differentiated from FIG. 33. Arcuate radii r are the same as each other on the orbiting side and on the fixed side (that is, r=e). Similarly to FIG. 33, a straight line connected to the arc is in contact with the circle whose radius is the half the orbiting radius e, at the points A and B by the origin O (or 0). FIG. 35 shows the arrangement of the winding start portion in a case where the inward curve of the volute body illustrated in FIG. 31 is taken as the basic volute curve. The inward curves 2*b* and 5*b* and the outward curves 2*a* and 5*a* are connected to each other by straight lines. In this case, the straight line is in contact with the circle whose radius is half the orbiting radius e, at the points A and B. However, the center C of this circle is not located on the origin O (or 0').

As apparent from the above description, a necessary condition of the connecting line connecting the inward curve forming the winding start portion of the volute body and the outward curve to each other is as follows: That is, when the connecting line is at least inscribed in the inward curve, and when the volute body 2 on the orbiting side and the volute body 5 on the fixed side are expressed by the same coordinate axis, the connecting line consists of an optional curve (including also a straight line and an arc) in which a circle whose radius is half the orbiting radius e is inscribed in a location between these connecting lines. With the arrangement of such winding start portion, although the description will be omitted, the top clearance volume is brought to zero, similarly to FIG. 25.

Figure 36:
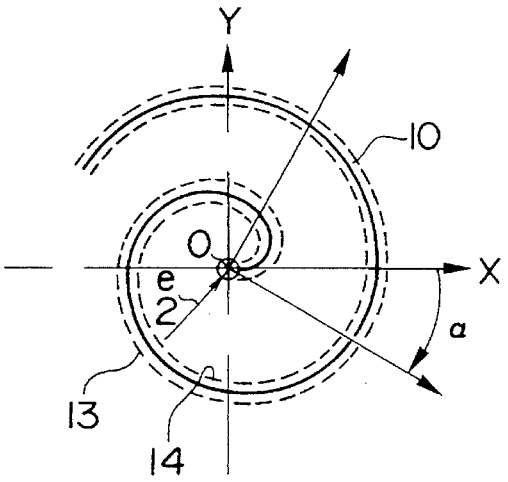
FIG. 36 is a schematic view for description of a forming method of a scroll configuration, showing a further embodiment of the invention.
Figure 37:
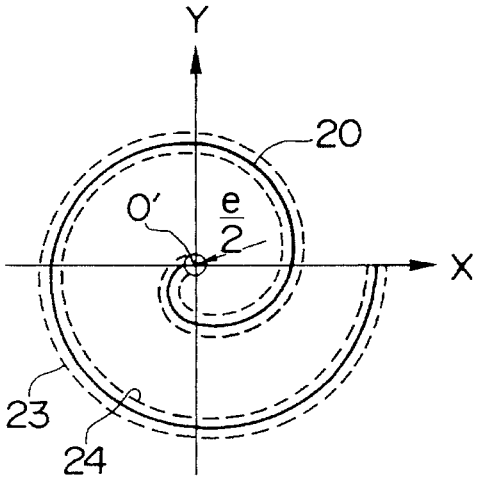
FIG. 37 is a schematic view for description of the forming method of the scroll configuration of the invention.
Figure 38:
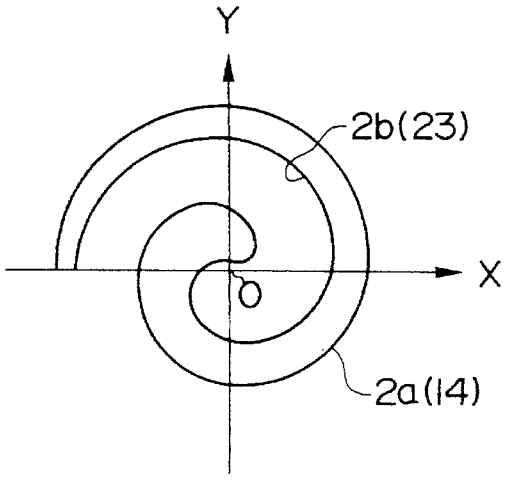
FIG. 38 is a schematic view of the forming method of the scroll configuration of the invention.
Figure 39:
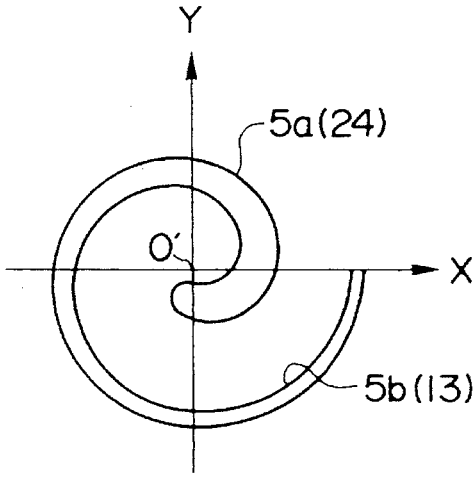

A fifth embodiment of the invention will be described with reference to FIGS. 36 to 43. Since the inward curve and the outward curve of the volute body are substantially connected to each other at the winding start portion, the connecting line as described above is substantially dispensed with, so that the arrangement can be simplified. FIGS. 36 and 37 show the basic volute curves on the orbiting side and on the fixed side, and an envelope of a circular locus drawn when the basic volute curve is moved in circle with a radius half the orbiting radius e. FIGS. 38 and 39 show the arrangements of the vortex curves on the orbiting side and on the fixed side. The solid line 10 shows the basic volute curve on the orbiting side, which is one in which the algebraic spiral expressed by the equation (1) is rotated only through the angle about the origin O. The broken lines 13 and 14 indicate envelopes of the basic volute curve 10. The reference numeral 13 denotes an outward envelope, while the reference numeral 14 denotes an inward envelope. Further, the solid line 20 indicates the basic volute curve on the fixed side. This curve is one in which the basic volute curve 10 on the orbiting side is rotated through $(180-\alpha)°$ about the origin O. The broken lines 23 and 24 indicate envelopes of the basic volute curve 20. The reference numeral 23 denotes an outward envelope, while the reference numeral 24 denotes an inward envelope. Here, the volute body is arranged as follows, such that contact between both the volutes for preparing a plurality of sealed volumes is geometrically secured. That is, the inward envelope 14 of the basic volute curve 10 on the orbiting side is selected as the orbiting outward curve 2*a*, while the inward envelope 24 of the basic volute curve 20 on the fixed side is selected as the fixed outward curve 5*a*. The inward curve of the volute body is such that since the orbiting inward curve 2*b* is in contact with the fixed outward curve 5*a*, the outward envelope 23 of the basic volute curve 20 on the fixed side is selected, while, since the fixed inward curve 5*b* is in contact with the orbiting outward curve 2*a*, the outward envelope 13 of the basic volute curve 10 on the orbiting side is selected. In this manner, the basic volute curve 10 on the orbiting side and the basic volute curve 20 on the fixed side are the same in configuration as each other, and are so arranged such that the phases are shifted $(180-\alpha)°$. Accordingly, it is possible to change the thickness of each of the volute walls on the orbiting side and on the fixed side. Since the inward curve and the outward curve which form each of the volute bodies are substantially connected to each other at the winding start portion, the connecting curve between them becomes substantially unnecessary, so that the arrangement can be simplified. With the arrangement described above, as the basic volute curve, it is possible to apply various curves similarly to the case illustrated in FIG. 25. In this connection, in a case where the angle $\alpha$ is 0°, the volute element on the orbiting side and the volute element on the fixed side are brought to the same configuration.

FIGS. 40 to 43 are views (in a case of $\alpha$=30°) showing a change in scroll configuration due to rotation (angle $\alpha$) of the basic volute curve and a meshing condition between the central portions of the respective volute bodies, in the method of forming the vortex curve illustrated in FIGS. 36 to 39. As shown in FIGS. 40 to 43, it is possible to change the thickness of each of the volute walls of the volute body on the orbiting side and the volute body 5 on the fixed side, by the value of the angle $\alpha$, similarly to the arrangement illustrated in FIGS. 27 to 30. The winding start portion of each of the volute bodies is formed by a smooth curve. The top clearance can also be brought to zero.

A sixth embodiment of the invention will be described with reference to FIGS. 44 to 47, which is similar to the embodiment of FIGS. 36 to 39, the inward curve and the outward curve of the volute body are smoothly connected to each other at the winding start portion. Thus, the arrangement can be simplified. In the embodiment of FIGS. 44–47, when the orbiting radius of the scroll compressor is e, two radii e1 and e2 satisfying e=e1+e2 are decided. These values are suitably selected, whereby it is possible to change the thickness of each of the volute walls of the volute body 2 on the orbiting side and the volute element 5 on the fixed side. FIGS. 44 and 45 indicate the basic volute curves on the orbiting side and on the fixed side and an envelope of a circular locus drawn when the basic volute curve is moved in circle with the radius e1 and the radius e2. FIGS. 46 and 47 are views showing the arrangements of the vortex curves on the orbiting side and on the fixed side. The solid line 10 indicates the basic volute curve on the orbiting side, which is the algebraic spiral expressed by the equation (1). The broken line 34 indicates an outward envelope at the time the basic volute curve 10 is moved in circle with the radius e1, while the broken line 35 indicates an inward envelope at the time the basic volute curve 10 is moved in circle with the radius e2. Further, the solid line 20 indicates the basic volute curve on the fixed side. This curve is one in which the basic volute curve 10 on the orbiting side is rotated through 180° about the origin O. The broken line 36 indicates the outward envelope at the time the basic volute curve 20 is moved in circle with the radius e2, while the broken line 37 indicates an inward envelope at the time the basic volute curve 20 is moved in circle with the radius e1. Here, the volute body is arranged as follows, such that the contact between both the volutes forming a plurality of sealed volumes is geometrically assured. That is, the inward envelope 35 of the basic volute curve 10 on the orbiting side is selected as the orbiting outward curve 2*a*, while the inward envelope 37 of the basic volute curve 20 on the fixed side is selected as the fixed outward curve 5*a*. As the inward curve of the volute body, the outward envelope 36 of the basic volute curve 20 on the fixed side spaced from the inward envelope 37 only by the distance of the orbiting radius e is selected because the orbiting inward curve 2*b* is in contact with the fixed outward curve 5*a* (37). Similarly, since the fixed inward curve 5*b* is in contact with the orbiting outward curve 2*a* (35), the outward envelope 34 of the basic volute curve 10 on the orbiting side spaced from the inward envelope 35 only by the distance of the orbiting radius e is selected. In this manner, the two envelopes e1 and e2 different in radius from each other with reference to the basic volute curve 10 and the basic volute curve 20 are considered and are brought to e1>e2, whereby the thickness of the volute wall is gradually changed by the winding angle of the volute. Regarding the volute body 2 on the orbiting side, the thickness of the volute wall can be formed thick as a whole as compared with the volute body 5 on the fixed side. In a case of e1<e2, it is possible that, reversely, the volute body 5 on the fixed side can be arranged thicker in volute wall than the volute body 2 on the orbiting side.

Further, in the above-described volute body forming method, normally, it is possible to make the minimum radius of curvature of the inward curve of the volute body larger than the orbiting radius e. Therefore, it is possible to increase the diameter of the cutter when the volute body is formed and to improve the dimensional accuracy and the workability of the volute body.

As described above, as the scroll fluid machine, the description has been made with the compressor cited, in which the another basic method of arranging the vortex curve of each of the volute bodies has been described above in which the thickness of the volute wall is continuously changed in accordance with the winding angle of the volute, and the thicknesses of the respective volute walls on the fixed side and on the orbiting side are different from each other. However, the invention can be applied also to an expander and a pump other than the above. Further, in the present invention, a movement or motion form of the scroll is a type in which one of the scrolls is fixed, while the other scroll is moved in revolution with an optional radius without being revolved about its own axis. However, the invention can be applied to a scroll fluid machine of both rotational types in which motion is brought relatively to a motion form equivalent to the above-described motion. Moreover, the algebraic spiral expressed by the equation (1) has been used as the basic volute curve of the vortex body. However, the invention should not be limited to this specific arrangement. The method of arranging the volute body, which has been cleared by the present invention, can be applied to any optional smooth vortex curves in which a curvature of the volute is changed continuously.

As described above, according to the invention, by the use of the algebraic spiral as the basic volute curve, the volute body can be miniaturized or reduced in size while the strength of the winding start portion of the volute body is secured. Accordingly, a bearing load is also reduced, and there can be provided a scroll fluid machine which is high in reliability. Furthermore, since the thickness of the volute wall can gradually be changed, the internal leakage of the fluid between the volute bodies can be reduced, and the top clearance volume can also be reduced or can also be brought to zero. Accordingly, it is possible to improve the efficiency of the scroll fluid machine. Moreover, the scroll fluid machine is loaded, whereby it is possible to provide an air conditioning facility which is superior in energy efficiency and high in reliability.

Moreover, even in a case where the materials of the volute bodies are different from each other in the orbiting side and on the fixed side, the method of arranging the volute bodies has been made apparent in which the thickness of the volute wall is continuously changed in accordance with the winding angle of the volute, while maintaining the thickness of the volute wall required in view of the strength. By the fact that the algebraic spiral is used as the basic volute curve, it is possible to miniaturize or reduce in size the volute body less than the involute curve, while the strength of the winding start portion of the volute body is maintained.

What is claimed is:

1. A scroll fluid machine in which a pair of scroll members having end plates and volute bodies perpendicular to said end plates, respectively, are in mesh with each other with said volute bodies facing inwardly, and one of said pair of scroll members is moved in revolution with an orbiting radius so as not to be apparently revolved with respect to the other scroll member, wherein the volute bodies of respective scrolls are such that one of an inward curve and an outward curve of one scroll is formed by an algebraic spiral, while another of said inward curve and said outward curve of said one scroll is formed by one of two envelopes drawn when an algebraic spiral of the volute body of the other scroll is moved in a circle with said orbiting radius.

2. A scroll fluid machine according to claim 1, wherein said algebraic spiral is formed by said algebraic spiral which is expressed by the equation $r=a\cdot\theta^k$, when a radius vector is r, an angle of deviation is θ, a coefficient of the algebraic spiral is a, and an exponent of the algebraic spiral is k, in the form of polar coordinates.

3. A scroll fluid machine according to claim 2, wherein said algebraic spiral is such that said exponent k is >1.0, and said coefficient a is set to a constant, and wherein said exponent k of said algebraic spiral is changed as a function of said angle of deviation θ.

4. A scroll fluid machine according to claim 1, wherein the algebraic spiral of said one scroll member is one in which said algebraic spiral is rotated through an angle α about an origin thereof, and wherein the algebraic spiral of the other scroll member is rotated through an angle (180°−α) about said origin.

5. A scroll fluid machine according to claim 1, wherein said one scroll member is an orbiting scroll member, and wherein a thickness of the volute body of the orbiting scroll member is formed thicker than that of the volute body of the other scroll member.

6. A scroll fluid machine in which a pair of an orbiting scroll member and a fixed scroll member having end plates and volute bodies perpendicular to said end plates, respectively, are in mesh with each other with said volute bodies facing inwardly, and said orbiting scroll member is moved in revolution so as not to be apparently revolved with respect to said fixed scroll member, wherein outward curves of the respective volute bodies of both said scroll members are formed by an algebraic spiral, and wherein inward curves of the respective volute bodies of both scroll members are such that said orbiting scroll member includes an outward envelope of said algebraic spiral of said fixed scroll member and said fixed scroll member includes an outward envelope of said algebraic spiral of said orbiting scroll member.

7. A scroll fluid machine in which a pair of orbiting scroll member and fixed scroll member having end plates and volute bodies perpendicular to said end plates, respectively, are in mesh with each other with said volute bodies facing inwardly, and said orbiting scroll member is moved in revolution so as not to be apparently revolved with respect to the fixed scroll member, wherein inward curves of respective volute elements of both said scroll members are formed by an algebraic spiral, and wherein outward curves of the respective volute bodies of both said scroll members are such that said orbiting scroll member includes an inward envelope of said algebraic spiral of said fixed scroll member and said fixed scroll member includes an inward envelope of said algebraic spiral of said orbiting scroll member.

8. A method of processing one of a pair of meshing scroll members, wherein an outward curve and an inward curve of a volute body of the scroll member is formed by an algebraic spiral or an envelope at the time said algebraic spiral is moved in orbiting, and wherein a center of a cutter is moved along an outward curve and an inward curve of another of the pair of scroll member to thereby execute processing of said volute body of said one scroll member.

9. A scroll fluid machine in which a pair of scroll members having end plates and volute bodies perpendicular to said end plates, respectively, are in mesh with each other with said volute bodies facing inwardly, and one of said pair of scroll members is moved in revolution with a predetermined orbiting radius so as not to be apparently revolved with respect to said other scroll member, wherein basic volute curves of the respective volute bodies of both said scrolls are formed by algebraic spirals in which a coefficient a of said algebraic spirals is changed in dependence upon an angle of deviation θ when a radius vector is r, the angle of deviation is θ, the coefficient of the algebraic spirals is a, and an exponent of the algebraic spirals is k, in the form of polar coordinates.

* * * * *